US006827124B2

(12) United States Patent
Garlock et al.

(10) Patent No.: US 6,827,124 B2
(45) Date of Patent: Dec. 7, 2004

(54) METHOD AND APPARATUS FOR USE DURING CASTING

(75) Inventors: Robert M. Garlock, Chardon, OH (US); Gary J. Vanek, Chardon, OH (US); Lawrence D. Graham, Chagrin Falls, OH (US)

(73) Assignee: PCC Airfoils, Inc., Cleveland, OH (US)

( * ) Notice: Subject to any disclaimer, the term of this patent is extended or adjusted under 35 U.S.C. 154(b) by 0 days.

(21) Appl. No.: 10/282,735

(22) Filed: Oct. 29, 2002

(65) Prior Publication Data

US 2004/0079510 A1 Apr. 29, 2004

(51) Int. Cl.[7] ..... B22D 27/04
(52) U.S. Cl. ..... 164/122.1; 164/122.2
(58) Field of Search ..... 164/122.1, 122.2, 164/338.1, 369

(56) References Cited

U.S. PATENT DOCUMENTS

| | | | | |
|---|---|---|---|---|
| 3,714,977 | A | 2/1973 | Terkelsen | |
| 3,810,504 | A | 5/1974 | Piwonka | |
| 4,108,236 | A | 8/1978 | Salkeid | |
| 4,712,604 | A | 12/1987 | Sawyer | |
| 4,757,856 | A | 7/1988 | George | |
| 4,763,716 | A | 8/1988 | Graham et al. | |
| 4,774,992 | A | 10/1988 | George | |
| 4,969,501 | A | 11/1990 | Brokloff et al. | |
| 5,429,176 | A | 7/1995 | Atkinson et al. | |
| 6,276,432 | B1 | 8/2001 | Thompson et al. | |
| 6,698,493 | B2 * | 3/2004 | Graham | 164/122.1 |

* cited by examiner

*Primary Examiner*—Kiley Stoner
*Assistant Examiner*—Len Tran
(74) *Attorney, Agent, or Firm*—Tarolli, Sundheim, Covell & Tummino L.L.P.

(57) ABSTRACT

A baffle includes a base and a seal having flexible segments which engage a mold structure. The base of the baffle may have a noncircular opening in which article mold portions of the mold structure are disposed. The baffle may be connected with the furnace assembly before a mold is moved into the furnace assembly or may be connected with the furnace assembly as the mold is moved into the furnace assembly. A projection connected with the mold structure may be utilized to orient the baffle relative to the mold structure. The projection may be a thermocouple assembly which extends from the chill plate. Alternatively, the projection may be a portion of the mold structure itself.

67 Claims, 7 Drawing Sheets

METHOD AND APPARATUS FOR USE DURING CASTING

BACKGROUND OF THE INVENTION

The present invention relates to a method and apparatus for use during casting of metal and more specifically to a baffle which is effective to at least partially block heat transfer from a furnace assembly as a mold is moved out of the furnace assembly.

A known apparatus for use in casting one or more metal articles includes a baffle which is connected with a furnace assembly. A chill plate is raised to move a mold supported by the chill plate through the baffle into the furnace assembly. During withdrawal of the mold from the furnace assembly, flexible segments of the baffle engage the mold to at least partially block the transfer of heat from the furnace assembly. This known baffle is disclosed in U.S. Pat. No. 4,969,501 to Brockloff, et al.

SUMMARY OF THE INVENTION

The present invention relates to a method and apparatus which is used during casting of molten metal in a mold structure. The mold structure may have a single article mold portion or a plurality of article mold portions depending upon whether one or more articles are to be cast in the mold structure. The apparatus includes a movable chill plate which supports the mold structure in a furnace assembly. An improved baffle is provided to retard transfer of heat from the mold structure when the mold structure is in the furnace assembly and during withdrawal of the mold structure from the furnace assembly.

It is contemplated that a base of the baffle may be constructed with either a circular or noncircular opening. When a plurality of articles are to be cast, the baffle may have a base with a noncircular opening. The noncircular opening may have lobes in which article mold portions of a mold structure for casting a plurality of articles are received. Flexible segments may extend from the base of the baffle into engagement with surfaces of the article mold portions of the mold structure.

The chill plate is lowered to withdraw the mold structure from the furnace assembly. During at least a portion of the withdrawal of the mold structure from the furnace assembly, the article mold portions of the mold structure are disposed in the lobes of the noncircular opening in the base of the baffle. As the mold structure is withdrawn from the furnace assembly, the flexible segments of the baffle at least partially block transfer of heat from the furnace assembly. In certain circumstances, it may be desired to omit the flexible segments.

When one or more articles are to be cast, the baffle may be positioned relative to the mold structure with the baffle extending around a portion of the mold structure and with flexible segments of the baffle disposed in engagement with the mold structure. The mold structure may be positioned on the chill plate either before or after the baffle is positioned relative to the mold structure. The chill plate, mold structure and baffle may be moved upward toward the furnace assembly to move at least a portion of the mold structure into the furnace assembly with the baffle extending around the mold structure. After molten metal has been poured into the mold structure, the chill plate and mold structure are moved downward relative to the furnace assembly and baffle. As the mold structure is moved downward, flexible segments of the baffle engage the mold structure to at least partially block heat transfer from the furnace assembly.

The baffle may advantageously be positioned relative to the mold structure by a projection. The projection may be formed by a thermocouple assembly which extends from the chill plate into the baffle. Alternatively, the mold structure may be formed with a projection which extends from the mold structure into the baffle. If desired, a member which is separate from the mold structure and the baffle may be moved through an opening in the baffle and the mold structure into an opening in the chill plate.

The baffle may be formed with a one piece base. The baffle may also include one or more sheets of material which form a seal in which the flexible segments are formed. The sheet or sheets of material and base of the baffle may each be maintained as one piece. Alternatively, the sheet or sheets of material and base of the baffle may be divided into a plurality of sections which are positioned relative to the mold structure.

BRIEF DESCRIPTION OF THE DRAWINGS

The foregoing and other features of the invention will become more apparent upon a consideration of the following description taken in connection with the accompanying drawings wherein.

DESCRIPTION OF SPECIFIC PREFERRED EMBODIMENTS OF THE INVENTION

General Description

Figure 1:
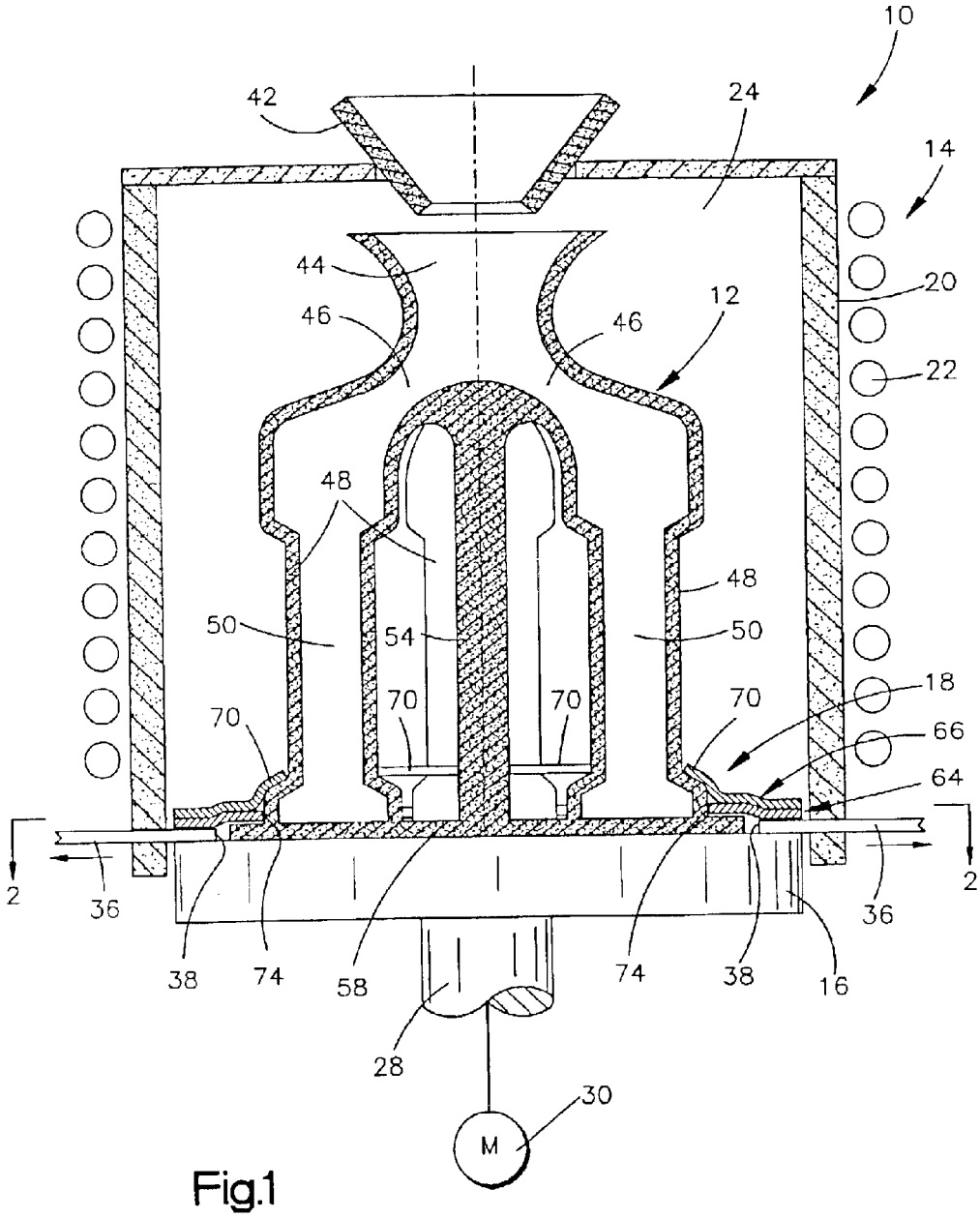
FIG. 1. is a schematic illustration depicting a relationship of a mold structure to a chill plate and baffle when the mold structure is disposed in a furnace assembly.

An apparatus 10 for use in casting molten metal in a mold structure 12 is illustrated schematically in FIG. 1. The apparatus 10 includes a furnace assembly 14, a chill plate 16 and an improved baffle 18. The furnace assembly 14 is of the well-known induction furnace type and includes a cylindrical graphite susceptor wall 20 enclosed by helical induction coil 22. When the induction coil 22 is energized, heat is transmitted to a cylindrical furnace chamber 24 in a known manner.

The circular chill plate 16 is supported by a cylindrical post 28 which is disposed in a coaxial relationship with the chill plate. The chill plate 16 may be water cooled. The chill plate 16 is maintained at a lower temperature than the mold structure 12 and is effective to conduct heat from the mold structure when molten metal is poured into the mold structure.

The chill plate 16 is raised and lowered relative to the furnace assembly 14 by operation of a motor 30 connected with the post 28. The motor 30 may be a reversible hydraulic motor of the piston and cylinder type. When the chill plate is in a lowered position, the mold structure 12 and baffle 18 are positioned on the chill plate. At this time, the mold structure is disposed below the furnace assembly 14. The motor 30 may be operated to raise the chill plate 16, mold structure 12 and baffle 18.

As the motor 30 is operated to raise the chill plate 16, mold structure 12, and baffle 18, the mold structure moves into the furnace chamber 24. Continued upward movement of the chill plate 16 moves the baffle 18 into the furnace chamber 24. Although the baffle 18 is moved into the furnace assembly 14 with the mold structure 12, if desired, the baffle may be connected with a lower end portion of the furnace assembly before the mold structure is moved into the furnace assembly.

As the mold structure 12 and baffle 18 move into the furnace chamber 24, a plurality of support pins 36 are in a retracted position in which ends 38 of the pins are disposed in the susceptor wall 20 out of the path of movement of the baffle 18 and chill plate 16. Once the mold 12 and baffle 18 have moved into the furnace chamber 24, the support pins are moved to the extended position illustrated in FIG. 1. When the support pins 36 are in the extended position, the ends 38 of the support pins are disposed beneath the baffle 18 and above the chill plate 16. Although only two support pins 36 are illustrated in FIG. 1, there are six support pins in a circular array adjacent to the lower end portion of the susceptor wall 20. Of course, a greater or lesser number of support pins may be utilized if desired.

Molten metal is poured from a ladle (not shown) into a funnel 42. The molten metal flows from the funnel 42 into a pour cup 44 in the mold structure 12. The molten metal flows from the pour cup 44 through runners 46 into article mold portions 48 of the mold structure 12. Each of the article mold portions 48 has an article mold cavity 50 having a configuration corresponding to the configuration of one of a plurality of articles to be cast in the mold structure 12.

The specific mold structure 12 illustrated in FIG. 1 has three article mold portions 48. However, the mold structure could have a greater or lesser number of article mold portions if desired. For example, the mold structure 12 could have only one article mold portion. Alternatively, the mold structure 12 may have a plurality article mold portions and be constructed in the manner disclosed in U.S. Pat. No. 4,969,501 or in 5,062,468. It should be understood that the mold structure 12 may have any desired construction.

The specific mold structure 12 illustrated in FIG. 1 is utilized to cast turbine blades. However, the mold structure 12 may be utilized to cast different articles if desired. The molten metal which is poured into the mold structure 12 and subsequently solidified to form the turbine blades may be a nickel chrome superalloy. The molten metal may be solidified with any desired crystallographic structure. Thus, the molten metal may be solidified with an equiaxed crystallographic structure, a columnar grain crystallographic structure, or as a single crystal. It should be understood that the mold structure 12 may be constructed to cast articles other than turbine blades out of metals other than nickel chrome super alloys.

A cylindrical downpole 54 extends from the pour cup 44 and upper end portions of the runners 46 to a circular base portion 58 of the mold structure 12. If desired, the downpole 54 may be omitted. The mold structure 12 is formed of a gas permeable ceramic mold material. The mold structure 12 is formed by the well-known lost wax process.

The mold structure 12 is advantageously formed as one piece of ceramic mold material. Thus, the article mold portions 48 are integrally formed as one piece with the base portion 58 of the mold structure 12. If it is desired to cast articles in the mold cavities 50 as a single crystal, a starter section similar to that disclosed in U.S. Pat. No. 5,062,468 may be provided in the mold structure 12 in association with each of the article mold cavities 50.

Baffle

The baffle 18 includes a base 64 and a seal 66 (FIG. 1). The base 64 and seal 66 both extend around a portion of the mold structure 12. The base 64 has a greater rigidity than the seal 66. The relatively stiff base 64 supports the seal 66 during withdrawal of the mold structure 12 from furnace chamber 24. The circular base 64 has a diameter which is only slightly smaller than the inside diameter of the furnace chamber 24.

The circular seal 66 is flexible and has segments 70 (FIGS. 1 and 2) which engage the article mold portions 48 and downpole 54. The seal 66 cooperates with the base 64 and mold structure 12 to at least partially block the transfer of heat from the lower end portion of the furnace chamber 24 during lowering of the chill plate 16 and mold structure 12 relative to the furnace assembly 14. Thus, the flexible seal 66 is supported by the stiff base 64. The seal 66 closes space between the irregular surface of the mold structure 12 and the base 64 during withdrawal of the mold structure from the furnace chamber 24.

When the mold structure 12 is to be utilized to cast metal articles, the baffle 18 is positioned adjacent to the lower end portion of the mold structure 12. At this time, the base 64 of the baffle 18 will rest on the circular base portion 58 of the mold structure 12. The flexible segments 70 of the seal 66 are resiliently deflected upward by engagement with irregular outer surface areas on the pour cup 44, runners 46, and article mold portions 48.

The base 64 of the baffle 18 has a noncircular central opening 74 (FIG. 2) which is large enough to enable the baffle to be moved along the mold structure 12. The seal 66 extends inward from the edge of the opening 74 in the base 64 into engagement with the mold structure 12. Thus, the seal 66 spans the space between the edge of the opening 74 and the mold structure 12.

The opening 74 will have a configuration which is a function of the configuration of the mold structure 12. For example, the opening 74 may have a circular configuration. Alternatively, the opening 74 may have a noncircular configuration with a plurality of arms to receive a plurality of portions of the mold structure.

Either before or after the baffle 18 is positioned on the mold structure 12, the mold structure is positioned on the chill plate 16 while the chill plate is in a lowered position. When the chill plate 16 is in the lowered position, there is sufficient clearance between the furnace assembly 14 and the chill plate to enable the mold structure 12 to be positioned on the chill plate without extending into the furnace chamber 24. Although it is believed that it may be desired to position the baffle 18 on the mold structure 12 and then to position both the mold structure and baffle on the chill plate 16, the mold structure 12 may be positioned on the chill plate 16 before the baffle 18 is positioned on the mold structure.

Once the mold structure 12 and baffle 18 have been positioned on the chill plate 16, the motor 30 (FIG. 1) is operated to raise the chill plate, mold structure and baffle toward the furnace assembly 14. At this time, the support pins 36 are withdrawn so that the ends 38 of the support pins are either in or closely adjacent to the susceptor wall 20. As the motor 30 continues to be operated to raise the chill plate 16, the baffle 18 moves above the support pins 36. As this occurs, the support pins are moved from their retracted positions to the extended positions shown in FIG. 1. This results in the support pins being moved beneath the base 64 of the baffle 18.

Figure 2:
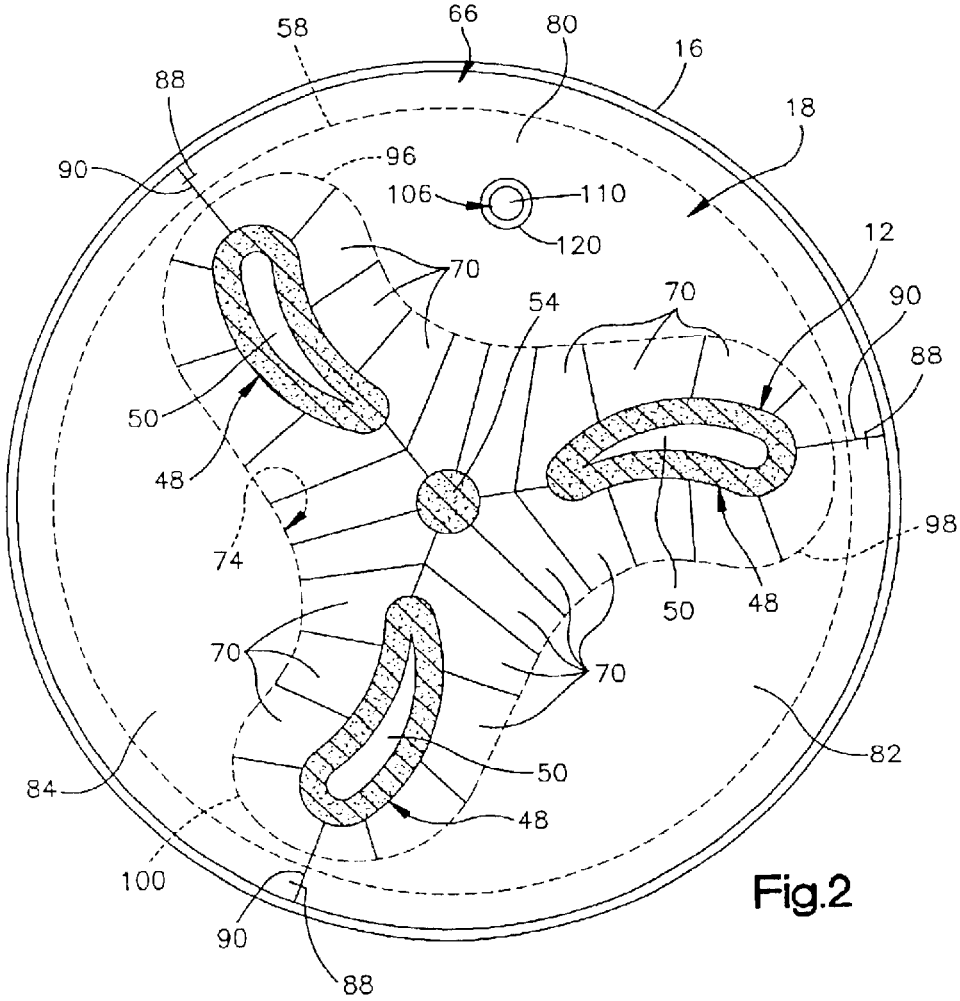
FIG. 2. is a schematic illustration taken generally along the line 2—2 of FIG. 1, further illustrating the relationship of the baffle to the mold structure and chill plate.

In the embodiment of FIGS. 1 and 2, the baffle 18 is moved into the furnace chamber 24 with the mold structure 12. However, the baffle 18 may be secured to the furnace assembly 14 before the mold structure is moved into the furnace assembly. If this is done, the support pins 36 may be omitted.

When the baffle 18 is secured to the furnace assembly 14 as previously mentioned, the mold structure 12 is positioned on the chill plate 16 in alignment with the opening 74 in the base of the baffle 18. The chill plate 16 and mold structure are moved upwardly relative to the stationary baffle 18 and furnace assembly 14. This moves the mold structure 12 to a position in which the article mold portions 48 of the mold structure are disposed in the furnace assembly 14 in alignment with the opening 74 in the baffle 18 and in which the flexible segments 70 of the baffle 18 engage the article mold portions of the mold structure.

Once the mold structure 12 has been positioned in the furnace assembly 14 (FIG. 1), the induction coil 22 is energized and the mold structure is preheated to the desired temperature. When the mold structure 12 has been preheated to the desired temperature, molten metal, for example a nickel chrome superalloy, is poured from a ladle through the funnel 42 into the mold structure. The molten metal flows from the pour cup 44 through the runners 46 into the article mold cavities 50. Once the article mold cavities 50 and runners 46 have been filled with molten metal, pouring of the molten metal is interrupted.

The motor 30 is then operated to slowly lower the chill plate 16 and mold structure 12 from the furnace chamber 24. As this occurs, the support pins 36 support the baffle 18 in a stationary position at the lower end portion of the furnace assembly 14. As the chill plate 16 is lowered, the flexible segments 70 of the baffle seal 66 engage the downwardly moving article mold portions 48 and downpole 54 of the mold structure 12 to block transfer of heat from the furnace assembly 24. The seal 66 is supported by the relatively rigid base 64. The base 64 is, itself, supported by the pins 36.

Figure 6:
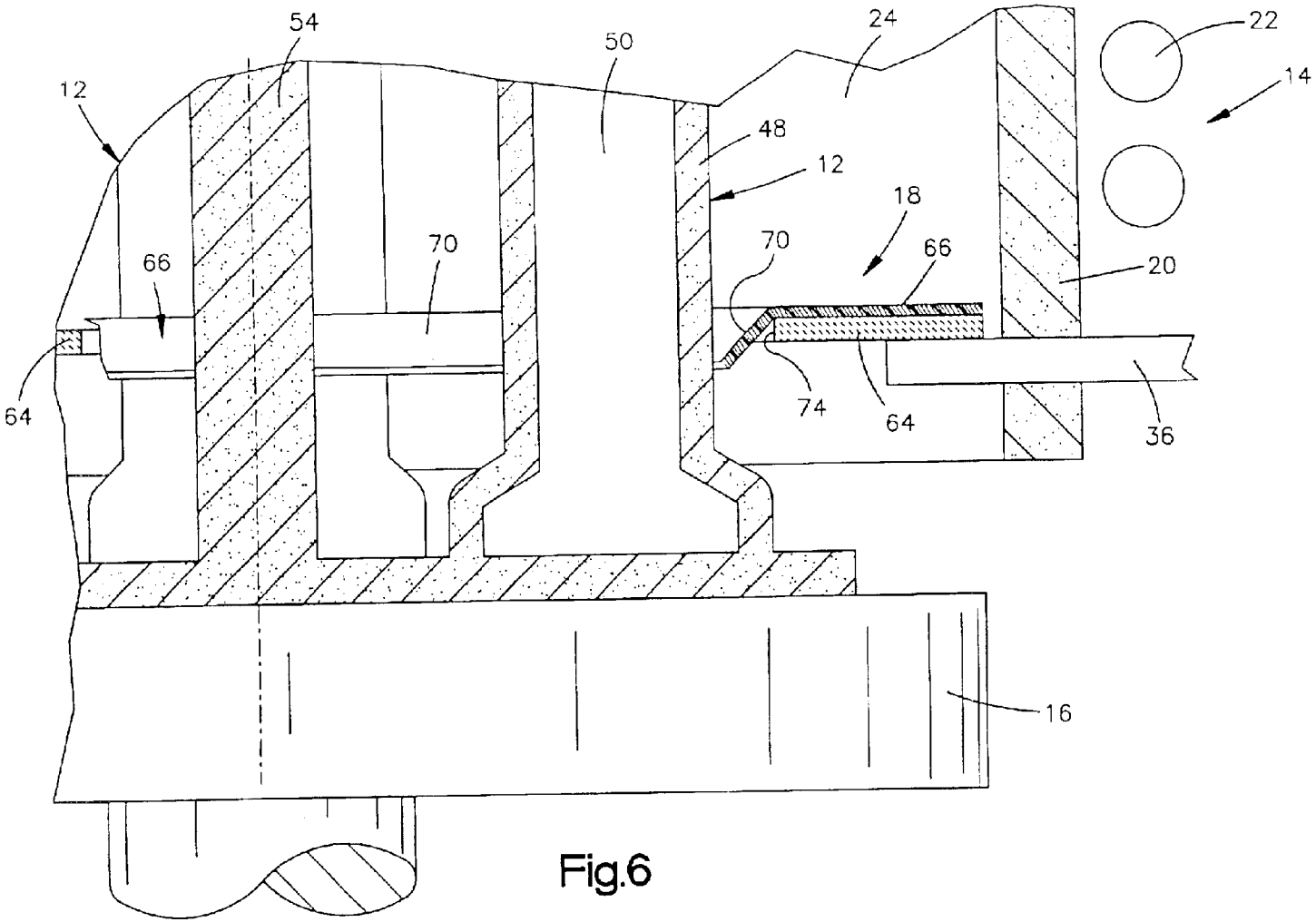
FIG. 6. is a schematic illustration depicting the relationship between the chill plate, mold structure, baffle, and furnace assembly of FIG. 1 during withdrawal of the mold structure from the furnace assembly.

During initial downward movement of the mold structure 12, the flexible segments 70 of the seal 66 are deflected from the upwardly extending orientation illustrated in FIG. 1 to a downwardly extending orientation illustrated in FIG. 6. The segments 70 are resiliently deflected by engagement with the mold structure 12. Thus, as the mold structure 12 begins to move downward, friction between the ends of the flexible segments 70 and the mold structure 12 pulls the flexible segments downward relative to the base 64 of the baffle 18 from the orientation illustrated in FIG. 1.

The ends of the flexible segments 70 remain in engagement with the mold structure 12 during downward movement of the mold structure from the furnace chamber 24. Thus, even though the outer surfaces of the article mold portions 48 may be rough and/or irregular, the flexible segments 70 are resiliently deflected and are maintained in engagement with the mold structure under the influence of the inherent resilience of the flexible segments. The flexible segments 70 of the seal 66 span the distance between the edge of the opening 74 in the base 64 of the baffle 18 and the mold structure 12 during withdrawal of the mold structure from the furnace chamber 24. Therefore, the opening 74 in the base 64 of the baffle 18 is blocked by the flexible segments 70 until the upper end portions of the article mold cavities 50 and at least a portion of the runners 46 have been withdrawn from the furnace chamber 24. This enables the flexible segments 70 to block heat transfer from the furnace chamber 24 to the relatively cool environment outside of the furnace chamber.

The flexible segments 70 of the seal 66 are flexed toward and away from coincident central axes of the mold structure 12 and baffle 18 as the mold structure is withdrawn from the furnace assembly 14. The flexible segments 70 flex toward the central axis of the baffle 18 under the influence of the natural resilience of the flexible segments, as the cross sectional size of a portion of the mold structure 12 decreases. The flexible segments 70 resiliently flex away from the central axis of the baffle 18 under the influence of force applied against the flexible segments by the side of the mold structure 12, as the cross sectional size of a portion of the mold structure increases.

As the mold structure 12 is withdrawn from the furnace chamber 24, the molten metal in the lower portions of the article mold cavities 50 solidifies. The temperature differential between the furnace chamber 24 and the environment around the furnace assembly 14 is sufficient to maintain a solidification front between the liquid molten metal in the article mold cavities 50 and the solidified molten metal at a location adjacent to the baffle 18. Thus, the solidification front between molten and solid metal in the article mold cavities 50 is maintained horizontal and in general alignment with the flexible segments 70 of the seal 66.

If the mold structure 12 is moved at a relatively rapid rate from the furnace chamber 24, the molten metal may solidify in the article mold cavities 50 with an equiaxed crystallographic structure. However, if the mold structure is withdrawn at a slower rate from the furnace chamber 24, the molten metal in the article mold cavities 50 may solidify with a columnar grain crystallographic structure. If the article mold cavities 50 in the mold structure 12 are associated with a single crystal starter, such as is disclosed in U.S. Pat. No. 5,062,468, and the mold structure is withdrawn slowly from the furnace chamber 24, the molten metal may solidify with a single crystal crystallographic structure.

Baffle Construction

The baffle 18 is formed by the base 64 and seal 66. The base 64 has sufficient rigidity to enable it to maintain its original shape during withdrawal of the mold structure from the furnace assembly 14. The base 64 may have a layered construction composed of one or more layers of graphite felt and graphite foil. The graphite felt is enclosed by the layers of graphite foil. However, it should be understood that the base 64 of the baffle could be formed of a different material and in a different manner if desired.

For example, the base 64 of the baffle 18 may be formed of a suitable ceramic or suitable refractory metal. Rather than having a multi layered construction, the base 64 of the baffle may be formed by a single piece of graphite felt or other material.

The illustrated seal 66 is formed from a single sheet of material. The material forming the seal 66 is resiliently flexible. The illustrated seal 66 is formed from a sheet of graphite. It is believed that it may be desired to form the seal 66 of "GRAFOIL" (Trademark) which is commercially available from Union Carbide Corporation having a place of business at 270 Park Avenue, New York, N.Y. Of course, a graphite sheet may be obtained from other sources if desired.

It should be understood that the seal 66 may be formed of a material other than graphite. For example, the seal 66 may be formed of a flexible refractory metal or flexible ceramic composition. However, it should be understood that both the base 64 and the seal 66 must be capable of withstanding relatively high temperatures. This is because the temperature in the furnace chamber 24 is approximately 3000° F. during preheating of the mold structure 12.

The baffle 18 may be formed by two separate pieces. Thus, the seal 66 may be separate from the base 64. Alternatively, the seal 66 may be fixedly secured to the base 64. The seal 66 may be secured to the base 64 with suitable fasteners, such as a staples, or with a suitable adhesive. The flexible layer forming the seal 66 may also form part of the base 64. For example, the base 64 may have a layered construction with one of the layers forming the seal 66.

The baffle 18 may have a construction which requires the base 64 and seal 66 to be moved axially downward over the mold structure 12 to position the baffle in engagement with the base portion 58 of the mold structure 12. However, it is believed that it may be desired to divide the baffle 18 into segments 80, 82 and 84 (FIG. 2). The segments 80, 82, and 84 may be individually positioned relative to the mold structure 12.

The segments 80, 82 and 84 of the baffle 18 are moved into position relative to the mold structure 12 along paths extending transverse to longitudinal central axis of the article mold cavities 50 and to a longitudinal central axis of the downpole 54. The baffle segment 80 is moved parallel to the base portion 58 to a position in which the flexible segments 70 of the portion of the seal 66 disposed on the baffle segment 80 engage the article mold portions 48. Similarly, the baffle segments 82 and 84 are moved parallel to the base portion 58 of the mold structure 12 into engagement with the article mold portions 48 and the downpole 54.

Once the baffle sections 80, 82 and 84 have been positioned relative to the mold structure 12 in the manner illustrated in FIGS. 1 and 2, the baffle segments may be interconnected. However, it should be understood that the baffle 18 may be used without interconnecting the segments 80, 82 and 84. It is believed that it may be desired to interconnect the segments 80, 82 and 84 of the baffle 18 to facilitate maintaining the baffle segments in a desired relationship with each other and with the mold structure 12.

Figure 3:
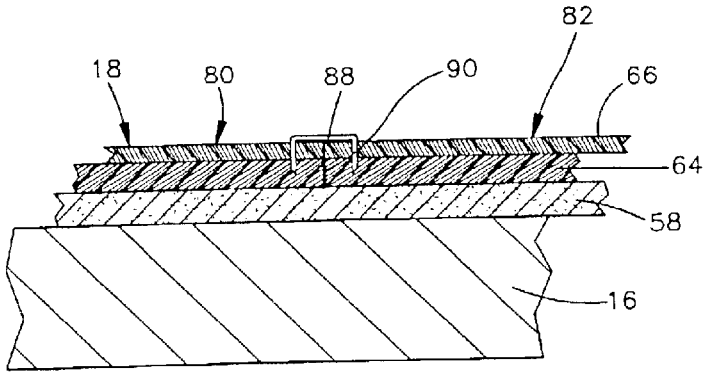
FIG. 3. is an enlarged schematic illustration depicting the manner in which sections of the baffle of FIGS. 1 and 2 are interconnected by a suitable fastener.

To interconnect the baffle segments, 80, 82 and 84, suitable fasteners are utilized. In the embodiment illustrated in FIGS. 2 and 3, staples 88 are utilized to interconnect the baffle segments. Thus, a staple 88 spans a joint 90 (FIG. 3) between the baffle segments 80 and 82 to interconnect the baffle segments and hold them against movement relative to each other. The staples 88 may be formed of a ceramic material or a refractory metal if desired.

Of course, connectors other than a staple may be utilized to interconnect the segments 80, 82, and 84 of the baffle 18. For example, adhesive, or a combination of adhesive and graphite cloth or a suitable tape may be utilized to interconnect the segments 80, 82 and 84 of the baffle 18. Although only a single connector 88 has been illustrated schematically in FIGS. 2 and 3 at each of the joints 90, it is contemplated that a plurality of connectors may be utilized at each of the joints 90. Alternatively, a single annular ring may be positioned adjacent to the periphery of the baffle 18 and connected to each of the segments 80, 82 and 84.

The base 64 of the baffle 18 may be formed of a layer of graphite felt disposed between two layers of graphite foil. The layered construction of the base 64 would enable a tongue and groove joints 90 to be formed between the segments 80, 82 and 84 of the baffle 18. For example, the layers of foil may be cut away from the segment 80 of the baffle 18 and the layer of graphite cut away from the segment 82 of the baffle. The projecting layer of graphite from the segment 80 of the baffle would be inserted into the space formed between the two layers of foil on the segment 82 of the baffle. The seal 66 may be formed by one or more of the layers of foil which form part of the base 64.

It is believed that it may be desired to locate the baffle 18 relative to the mold structure 12 so that the article mold portions 48 are disposed in the same spatial relationship with the edge of the noncircular opening 74 in the base 64 of the baffle 18. The noncircular opening 74 has a plurality of lobes 96, 98, and 100 (FIG. 2) which have the same configuration. The article mold portions 48 of the mold structure 12 are each disposed in one of the lobes 96, 98 or 100 of the noncircular opening 74. Of course, if a greater or lesser number of article mold portions 48 are provided in the mold structure 12, a greater or lesser number of lobes would be provided in the noncircular opening 74. The spacing between the lobes in the opening 74 would vary as a function of the construction of the mold structure 12 and the spacing between the article mold portions 48 of the mold structure.

The lobes 96, 98 and 100 of the noncircular opening 74 have a size and configuration which enables the upper (as viewed in FIG. 1) end portion of the mold structure to move through the noncircular opening 74 without interference with the base 64 of the baffle 18. The size and configuration of the opening 74 enables the portion of the mold structure 12 disposed above the base portion 58 of the mold structure to move through the opening during withdrawal of the mold structure from the furnace assembly 14. The irregular configuration of the opening 74 is such as to minimize the length of the flexible segments 70. The opening 74 has a size and configuration which is a function of the size and configuration of the mold structure 12 at a location where the cross sectional size of the mold structure is a maximum.

With some mold structures 12, the lobes 96, 98 and 100 may be eliminated. This is because some mold structures have a relatively uniform cross sectional configuration throughout their vertical extent. The specific configuration the opening 74 will depend upon the configuration of the mold structure 12 with which the baffle 18 is to be used. For example, the opening 74 may have a circular configuration or a polygonal configuration if desired. With some mold structures it may be desired to form the opening 74 with a generally triangular configuration.

If and when the flexible segments 70 are omitted, the lobes 96, 98 and 100 in the base 64 may be used to minimize open space between the mold structure 14 and the baffle 18. However, with many mold structures it may be desired to utilize both the lobes 96, 98 and 100 and the flexible segments 70. It is believed that combination of the lobes 96, 98 and 100 and the flexible segments 70 will tend to minimize heat transfer from the furnace chamber 24. However, either the lobes 96, 98 and 100 or the flexible segments 70 may be omitted if desired.

Baffle Positioning

In order to have a desired relationship between the article mold portions 48 of the mold structure 12 and the lobes 96, 98 and 100 of the noncircular opening 74 in the base 64 of the baffle 18, the baffle is located in a predetermined position relative to the mold structure 12. To locate the baffle 18 in a predetermined position relative to the mold structure 12, an index projection is provided.

A thermocouple assembly 106 (FIGS. 2 and 4) may be utilized as the index projection to locate the baffle 18 relative to the mold structure 12. In addition, the thermocouple assembly 106 locates the mold structure 12 relative to the chill plate 16. This results in the baffle 18, mold structure 12, and chill plate 16 being interconnected and held in a desired spatial relationship relative to each other by the thermocouple assembly 106. During preheating of the mold structure 12 and pouring of molten metal into the mold structure, the thermocouple assembly has an output indicative of the temperature in the furnace chamber 24.

The thermocouple assembly 106 (FIG. 4) includes a cylindrical ceramic tube 110 which extends upward through an opening 112 in the chill plate 16. The ceramic tube 110 also extends through an opening 114 in the circular base portion 58 of the mold structure 12. By extending through the opening 112 in the circular chill plate 16 and through the opening 114 in the circular base portion 58 of the mold structure 12, the circular base portion of the mold structure is initially positioned relative to the circular chill plate 16. The circular periphery of the base portion 58 of the mold structure 12 can then be aligned with the circular periphery of the chill plate 16.

In addition, the ceramic tube 110 of the thermocouple assembly 106 extends through the baffle 18 (FIG. 4) to initially position the baffle relative to the mold structure 12. Thus, the ceramic tube 110 of the thermocouple assembly 106 extends through an opening 118 in the base 64 of the baffle 18 and through an opening 120 in the seal 66 of the baffle 18. By extending through the openings 118 and 120 in the baffle 18, the baffle is initially located relative to both the mold structure 12 and the chill plate 16. The periphery of the baffle 18 is then aligned with the circular periphery of the chill plate 16 and base portion 58 of the mold structure 12.

The openings 118 and 120 in the baffle 18 are disposed in the segment 80 (FIG. 2) of the baffle 18. Once the segment 80 of the baffle 18 has been located relative to the mold structure 12 by the thermocouple assembly 106, the other two segments 82 and 84 of the baffle are located relative to the mold structure by engagement between the segments 80, 82 and 84 of the baffle at the joints 90. The circular baffle 18 has a diameter which is only slightly smaller than the diameter of the chill plate 16 (FIG. 2). Therefore, once the thermocouple assembly 106 has been utilized to position the baffle segment 80 relative to the mold structure 12, it is relatively easy to align the circular periphery of the baffle 18 with the circular periphery of the chill plate 16. During withdrawal of the mold structure 12 from the furnace assembly 14, the thermocouple assembly 106 is moved out of the openings 118 and 120 (FIG. 4) in the baffle.

It is contemplated that the thermocouple assembly 106 may have many different constructions. In the specific construction of the thermocouple assembly 106 illustrated in FIG. 4, the ceramic tube 110 is connected to the chill plate 16 by a bracket 124. The bracket 124 is connected to the bottom of the chill plate 16 by a suitable fastener 126. The bracket 124 engages an annular groove 128 in the cylindrical ceramic tube 110. The upper end of the ceramic tube 110 is closed by the ceramic material of the tube.

The thermocouple assembly 106 includes a cylindrical refractory metal housing 134 which is disposed in a coaxial relationship with the ceramic tube 110. Dissimilar metals of the thermocouple are enclosed within the housing 134. The dissimilar metals are connected with a current measuring instrument by leads 136 and 138. It is contemplated that the thermocouple assembly 106 may have any one of many known constructions. The leads 136 and 138 conduct an electrical signal indicative of the temperature to which the thermocouple assembly 106 is exposed. By having the thermocouple assembly 106 extend through the chill plate 16, base portion of the mold structure 12, and baffle 18, they are located relative to each other.

It should be understood that the baffle 18 and mold structure 12 may be positioned relative to each other and/or to the chill plate 16 in ways other than utilizing the thermocouple assembly 106. For example, a projection from the chill plate 16 may extend through an opening in the base portion 58 of the mold structure 12 and through an opening in the baffle 18 to position the baffle and mold structure relative to each other and to the chill plate. Alternatively, openings in the chill plate 16, base portion 58 of the mold structure 12 and baffle 18 may be aligned by a pin or other member inserted into the openings to position the baffle relative to the mold structure.

Support Pins

The support pins 36 (FIG. 1) are movable between the extended position illustrated in FIG. 1 and a retracted position. When the support pins 36 are in the retracted position, the ends 38 of the support pins are enclosed by the susceptor wall 20. One specific mechanism 142 for moving the support pins 36 relative to the susceptor wall 20 of the furnace assembly 14 is illustrated schematically in FIG. 5. The mechanism 142 includes a bell crank 144 which is connected with one of the support pins 36.

The bell crank 144 (FIG. 5) is pivotally mounted at a connection 146. An actuator rod 148 is connected with the bell crank at a pivot connection 150. When the support pin 36 is to be moved from the extended position of FIG. 1 to the retracted position, the actuator rod 148 is pulled downward, in the direction of the arrow 154 of FIG. 5. This results in the bell crank 144 being pivoted in a counterclockwise direction about the connection 146.

The support pin 136 is connected with the bell crank 144 at a slot 158. In the embodiment illustrated in FIG. 5, a pin 160 is fixedly connected to the support pin 36 and extends into the slot 158 in the bell crank 144. When the bell crank 144 is pivoted, in a counterclockwise direction (as viewed in FIG. 5), the pin 160 is moved from the position shown in solid lines to the position shown in dashed lines. As this occurs, force is transmitted from the bell crank 144 through the pin 160 to pull the support pin 36 toward the left (as viewed in FIG. 5) to a retracted position.

The support pin 36 may be supported by a suitable bearing 164 in the susceptor wall 16. When the support pin 136 is in the retracted position, an end 38 of the support pin is disposed in the bearing 164.

Figure 5:
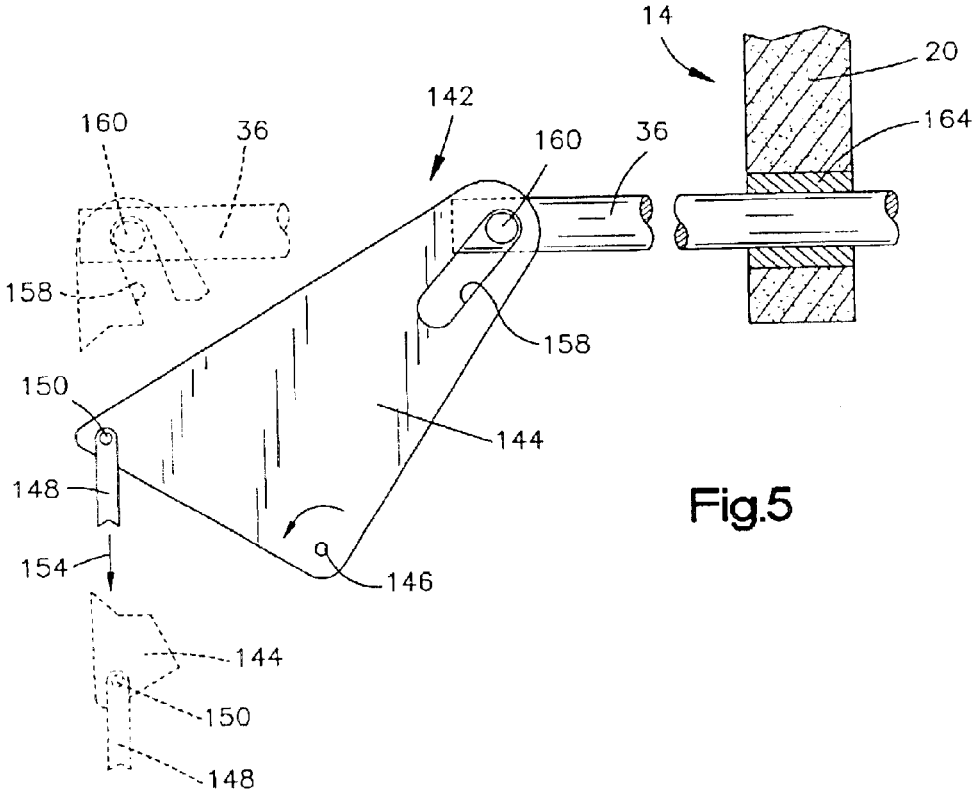
FIG. 5. is a schematic illustration depicting a mechanism which may be utilized to move baffle support members between an extended position in which they are effective to support the baffle of FIGS. 1 and 2 and a retracted position in which they are ineffective to support the baffle.

Although only a single bell crank 144 has been illustrated in FIG. 5 in association with a single support pin 36, it should be understood that there are a plurality bell cranks connected with a plurality of support pins 36. For example, six bell cranks 144 may be connected with six support pins 36. Of course, a greater or smaller number of bell cranks 144 and support pins 36 may be provided if desired.

The actuator rods 148 connected with the plurality of bell cranks 144 are interconnected. Therefore, the actuator rods 148 are all pulled downward together to simultaneously move the support pins 36 from the extended position illustrated in solid lines in FIG. 5 to the retracted position illustrated in dash lines illustrated in FIG. 5. When the support pins 36 are to be moved from the retracted position illustrated in dash lines in FIG. 5 back to the extended position, the actuator rods 148 are moved upward to simultaneously pivot the bell cranks 144 to move the support pins 36 from the retracted position illustrated in dash lines in FIG. 5 back to the extended position illustrated in solid lines in FIG. 5.

It should be understood that the support pins 36 may be moved between the extended and retracted positions by a mechanism other than the bell cranks 144. For example, a plurality of motors, either hydraulic, pneumatic, or electric, may be connected with the support pins 36. Operation of the motors would move the support pins 36. Alternatively, a rack and pinion gear mechanism may be provided in association with each of the support pins 36.

Casting of Articles

When articles are to be cast, the mold structure 12 is formed. The mold structure 12 may be formed in any desired manner and may have article mold portions 48 shaped to cast any desired article. Although it is believed that it may be desired to have article mold portions 48 of the same size and configuration, the article mold portions could be formed of a different size and configuration so as to mold cast metal articles having different sizes and configurations.

Although the mold structure 12 may be formed in any one of many known ways, it is contemplated the mold structure advantageously be formed by using the lost wax process. When this is to be done, a slurry of ceramic mold material is prepared and applied to a pattern having a configuration corresponding to the desired configuration of the article mold cavities 50 and runners 46. The ceramic slurry may have the composition disclosed in U.S. Pat. No. 4,947,927 and be applied to a pattern in the manner described in that patent. Of course, the slurry may have a different composition and may be applied in a different manner to the pattern. If desired, the mold structure 12 may be formed by a method other than the lost wax method of forming a mold structure.

Once the mold structure 12 has been formed, the mold structure, baffle 18 and chill plate 16 are positioned relative to each other. The baffle 18 may be positioned relative to the mold structure 12 while the mold structure is spaced from the chill plate 16. Alternatively, the baffle 18 may be positioned relative to the mold structure 12 while the mold structure is on the chill plate 16.

It is believed that it may be desired to position the mold structure 12 on the chill plate 16 before positioning the baffle 18 on the mold structure. The thermocouple assembly 106 may be then positioned relative to the mold structure 12 and chill plate 16. Once the mold structure 12 has been located relative to the chill plate 16 by the thermocouple assembly 106, the baffle 18 may be positioned relative to the mold structure.

By forming the baffle 18 with a plurality of segments 80, 82 and 84, positioning of the baffle relative to the mold structure 12 is facilitated. Thus, the baffle segment 80 may be moved into position relative to the mold structure 12. As this is done, the baffle segment 80 is moved downward so that the thermocouple assembly 106 moves through the openings 118 and 120 (FIG. 4) in the baffle segment 80.

Once the baffle segment 80 has been positioned on the base portion 58 of the mold structure 12 with the thermocouple assembly 106 extending through the opening in the baffle segment, the baffle segment 80 is aligned with the periphery of the chill plate 16. This results in the baffle segment 80 being located in the position illustrated in FIG. 2. At this time, the flexible segments 70 which form part of the baffle segment 80, engage the mold structure 12 and downpole 54.

The baffle segments 82 and 84 are then positioned relative to the mold structure 12. The baffle segments 82 and 84 are positioned on the base portion 58 of the mold structure 12 with the flexible segments 70 of these baffle segments extending into engagement with the mold structure 12 and downpole 54 in the manner illustrated schematically in FIG. 2. Engagement of the base 64 of the baffle segments 82 and 84 with the base of the baffle segment 80 positions the baffle segments 82 and 84 relative to each other and to the baffle segment 80. Of course, the baffle segments 82 and 84 are also aligned with the circular periphery of the chill plate 16.

Once the baffle segments 80, 82 and 84 have been positioned on the base portion 58 of the mold structure 12, in the manner illustrated schematically in FIGS. 1 and 2, the baffle segments may be interconnected. Staples 88 (FIGS. 2 and 3) of a refractory metal may be used to connect the segments 80, 82 and 84 of the baffle 18. Of course, the segments 80, 82 and 84 of the baffle 18 may be interconnected in a different manner if desired. It is contemplated that it may be desired to leave the baffle segments 80, 82 and 84 loose on the base portion 58 of the mold structure 12 without interconnecting the baffle segments.

Once the baffle 18 has been positioned relative to the mold structure 12, either before or after positioning of the mold structure on the chill plate 16, the chill plate is raised to move the mold structure 12 and baffle 18 into the furnace assembly 14 (FIG. 1). At this time, the bell cranks 144 will have been pivoted to the position illustrated in dash lines in FIG. 5 to withdraw the support pins 36 from the furnace chamber 24.

Once the chill plate 16 has been moved to the raised position illustrated in FIG. 1 and the mold structure 12 and baffle 18 positioned in the furnace chamber 24, the bell cranks 144 are pivoted from the position illustrated in dash lines in FIG. 5 to the position illustrated in solid lines in FIG. 5. As this occurs, the support pins 36 (FIG. 1) are moved to their extended positions between the chill plate 16 and baffle 18.

The end portions 38 of the extended support pins 36 are disposed in the furnace chamber 24. The end portions 38 of the extended support pins 36 are located above the upper surface of the chill plate 16 and beneath the lower surface of the baffle 18, in the manner illustrated in FIG. 1. In the illustrated embodiment of the apparatus 10, there are two support pins 36 disposed beneath each of the baffle segments 80, 82 and 84.

While the mold structure 12 is in the raised position illustrated in FIG. 1, molten metal is poured through the funnel 42. The molten metal may be a nickel chrome superalloy. Alternatively, a different molten metal may be utilized, for example, titanium or a titanium alloy may be poured through the funnel 42 into the mold structure 12.

Although one specific mold structure has been illustrated in FIGS. 1 and 2, it is contemplated that the mold structure 12 could have a different construction if desired. For example, the mold structure may have any one of the constructions disclosed in U.S. Pat. Nos. 4,673,021; 4,667,728; 4,862,947; and/or 4,905,752. Of course, the mold structure 12 could have a construction which is different than the construction illustrated in any one of the aforementioned U.S. patents.

Once the molten metal has been poured into the mold structure 12, the mold structure is withdrawn from the furnace chamber 24. To withdraw the mold structure 12 from the furnace chamber 24, the chill plate 16 is lowered, that is moved downwardly as viewed in FIG. 1, relative to the furnace assembly 12. As the chill plate 16 begins to move downward, the base 64 of the baffle 18 is supported by the support pins 36.

As the chill plate 16 continues to move downward, the flexible segments 70 of the stationary baffle 18 are pivoted from the upwardly extending orientation illustration in FIG. 1 to a downwardly extending orientation (FIG. 6) by engagement of the flexible segments with the irregular exterior surface of the mold structure 12. The thermocouple assembly 106 moves downward with the chill plate 16. As this occurs, the thermocouple assembly 106 is withdrawn from the openings 118 and 120 in the stationary baffle 18.

The flexible segments 70 of the baffle 18 engage each other, the article mold portions 48 of the mold structure 12, and the downpole 54 to completely close the noncircular opening 74 through the base 64 of the baffle 18 in the manner illustrated schematically in FIGS. 2 and 6. The baffle 18 closes the lower end of the furnace chamber 24. Since the entire opening 74 in the baffle 18 is closed and the lower end of the furnace chamber 24 is closed, there is minimal transfer of heat from the furnace chamber 24. As the mold structure 12 is withdrawn from the furnace assembly 14, engagement of the flexible segments 70 of the baffle 18 with the mold structure maintains the baffle 18 in a desired orientation relative to the mold structure even though the thermocouple assembly 106 has been moved out of the openings in the baffle by downward movement of the chill plate 16.

As the chill plate 16 continues to withdraw the mold structure 12 from the furnace chamber 24, the upper end portion of the mold structure 12 moves downward into engagement with the baffle 18. The illustrated upper end portion of the mold structure 12 extends outward so as to increase the extent to which the flexible segments 70 are deflected downward as the upper end portion of the mold structure moves into engagement with the baffle 18. Even though the extent of deflection of the flexible segment 70 increases, the flexible segments are still effective to close the opening 74 in the base 64 of the baffle 18. As the runners 46 move through the baffle 18, the flexible segments 70 are further deflected. The flexible segments maintain their engagement with the exterior of the mold structure 12 to minimize the transfer of heat from the furnace assembly 24.

Once the mold structure 12 has been completely withdrawn from the furnace chamber 24, the pour cup 44 is disposed beneath the baffle 18. At this time, the bell cranks 144 may be pivoted to pull the support pins 36 from the illustrated extended position back to their retracted positions. As this occurs, the baffle 18 is released and drops downward onto the mold structure 12. The mold structure 12 and baffle 18 may then be removed from a housing which encloses the furnace assembly 14.

The general construction of the housing which encloses the furnace assembly 14 and the manner in which it is utilized in association with the furnace assembly during the casting of metal articles may be the same as is disclosed in U.S. Pat. No. 3,841,384. Of course, the baffle 18 may be utilized in association with a different type of housing and/or furnace assembly. For example, the baffle 18 may be utilized with an apparatus that may have a construction similar to any one of the constructions disclosed in U.S. patent application Ser. No. 09/569,906 filed May 11, 2000 by Lawrence D. Graham and Brad L. Raguth and entitled System For Casting A Metal Article Using A Fluidized Bed. Of course, the baffle may be utilized in association with a furnace assembly in a different type of environment if desired.

Since the flexible segments 70 of the baffle 18 completely close the noncircular opening 74 in the base 64 of the baffle, in the manner illustrated schematically in FIG. 2, the baffle enables a relatively large temperature differential to be maintained between the furnace chamber 24 and the environment outside of the furnace assembly during withdrawal of the mold structure 12 from the furnace assembly. This relatively large temperature differential enables articles to be cast with a crystallographic structure which would be difficult, if not impossible to obtain without the baffle 18. Specifically, using the baffle 18, the dendrite arm spacing in a cast article may be minimized. Without the use of the baffle 18, dendrite arm spacing of 600 microns or less is difficult, if not impossible, to obtain. By using the baffle 18, a dendrite arm spacing of less than 500 microns has been obtained.

Multilayered Baffle

Figure 7:
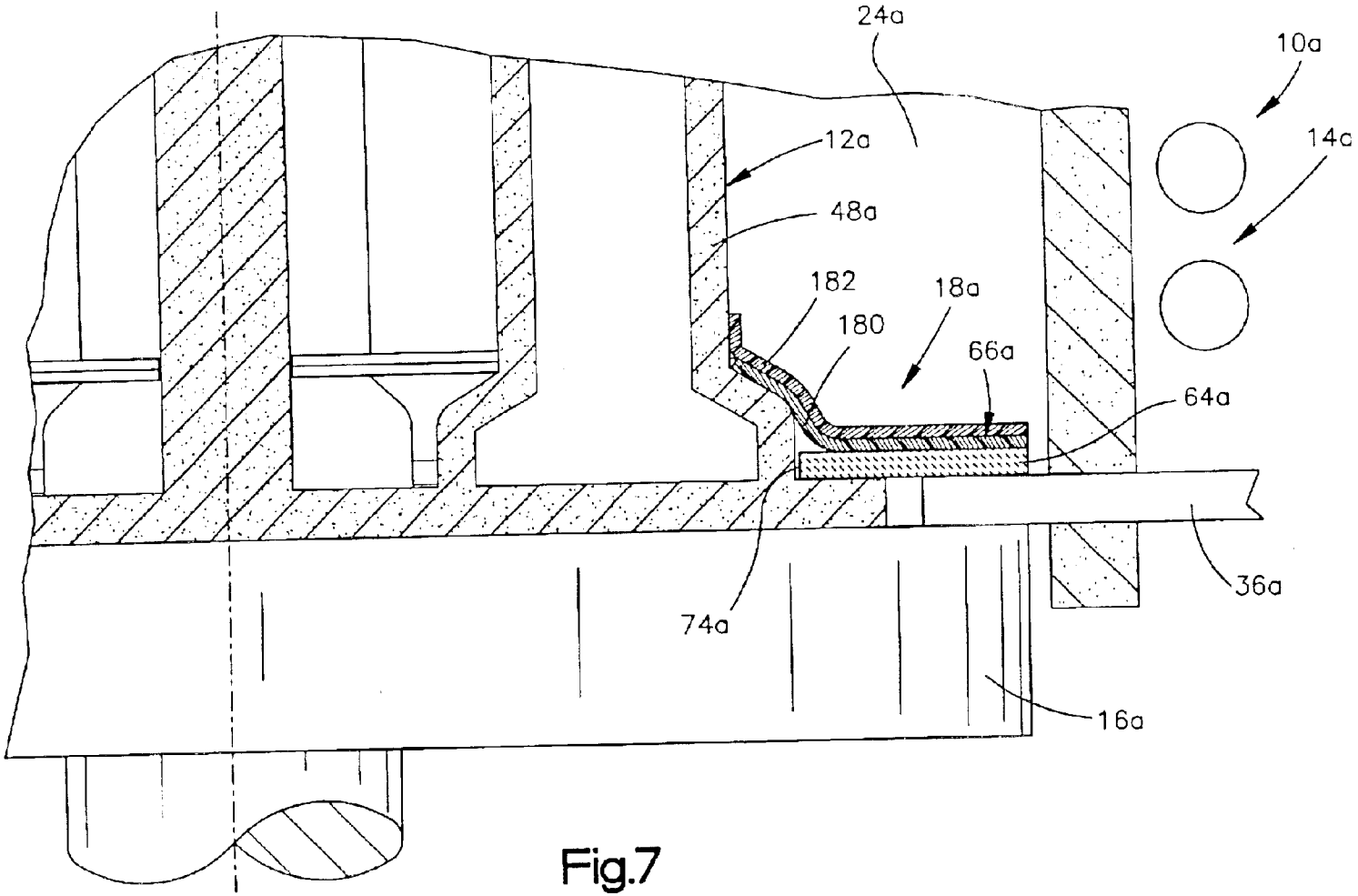
FIG. 7. is an enlarged schematic illustration depicting an embodiment of the baffle which a seal includes a plurality of flexible sheets disposed on a base.

The baffle 18 of FIGS. 1–6 has two layers, that is, the base 64 and the seal 66. The embodiment of the baffle illustrated in FIG. 7 has a multilayered seal. Since the apparatus of FIG. 7 is generally similar to the apparatus of FIGS. 1–6, similar numerals will be utilized to designate similar components. The suffix letter "a" being associated with the numerals of FIG. 7 to avoid confusion.

An apparatus 10*a* is used utilized to cast molten metal in a mold structure 12*a*. The apparatus 10*a* includes a furnace assembly 14*a* and a chill plate 16*a*. During the pouring of molten metal into the mold structure 12*a*, the mold structure is supported in a furnace chamber 24*a* on the chill plate 16*a* in the manner previously described in conjunction with the embodiment of the invention illustrated in FIGS. 1–6. A baffle 18*a* is supported by support pins 36*a* during withdrawal of the mold structure 12*a* from the furnace assembly 14*a*. If desired, the support pins 36*a* may be eliminated and the baffle 18*a* fixedly connected to the lower end portion of the furnace assembly 14*a*. During withdrawal of the mold structure 12*a* from the furnace assembly 14*a*, the baffle engages article mold portions 48*a* of the mold structure 12*a*.

The baffle 18*a* includes a base 64*a* and a seal 66*a*. The base 64*a* may have the same construction as the base 64 of FIGS. 1 and 2. The seal 66*a* has the same general construction as the seal 66 of FIGS. 1 and 2. The baffle 18*a* has segments corresponding to the baffle segments 80, 82 and 84 of FIG. 2. However, the baffle 18*a* may have a circular construction without being segmented.

The seal 66*a* has a multilayered construction. Thus, the seal 66*a* has a circular lower layer 180 and a circular upper layer 182 (FIG. 7). The upper and lower layers 180 and 182 may be loosely positioned on the base 64*a* or may be connected with the base and each other.

A layer of adhesive may be applied to the upper side of the base 64*a* to connect the lower layer 180 of the seal 66*a* with the base. Similarly, a layer of adhesive may be applied to upper side surface of the lower layer 180 at a location spaced from flexible segments in the lower layer. The layer of adhesive on the upper side of the lower layer 180 would connect the upper layer 182 to the lower layer. The layers 180 and 182 may be connected with each other and the base 64*a* by a fastener other than adhesive. For example, staples, similar to the staples 88 of FIGS. 2 and 3, may be used to connect the layers 180 and 182 with the base 64*a*.

The upper and lower layers 180 and 182 of the seal 66*a* have the same general construction as the seal 66 of FIGS. 1 and 2. Thus, both the lower layer 180 and upper layer 182 of the seal 66*a* are provided with flexible segments, corresponding to the flexible segments 70 of FIG. 2. However, the flexible segments of the upper layer have a different length than the flexible segments of the lower layer. By having the flexible segments with different lengths, maintaining of the seal 66*a* in engagement with the mold structure 12*a* with relatively large changes in the surface configuration of the mold structure is facilitated.

The lower layer 180 of the seal 66 may be constructed with flexible segments, corresponding to the flexible segment 70 of FIG. 2, which have a length which is shorter than the length of flexible segments forming the upper layer 182. By forming the flexible segments of the lower layer 180 of the seal 66*a* with a length which is shorter than the length of the flexible segments of the upper layer, the flexible segments of the lower layer would support the flexible segments of the upper layer at locations where there is a relatively large distance between the periphery of the noncircular opening 74*a* in the base 64*a* and the mold structure 12*a*. Of course, the upper layer 182 may be constructed with shorter flexible segments, corresponding to the flexible segment 70 of FIG. 2, than the flexible segments of the lower layer 180. This would result in the relatively short stiff flexible segments of the upper layer remaining in a generally radially extending orientation until the relatively large size upper end portion of the mold structure is being withdrawn from the furnace chamber 24.

Although the specific multilayered baffle 18*a* has a seal 66*a* with only two layers 180 and 182, it is contemplated that the seal may have a greater number of layers if desired. For example, the seal 66*a* may have three or four layers. The flexible segments of the various layers of the seal may have different lengths to provide for sequential disengagement of the flexible segments from portions of the mold structure 12*a* having varying cross sectional areas.

Alternative Baffle Positioning

Figure 8:
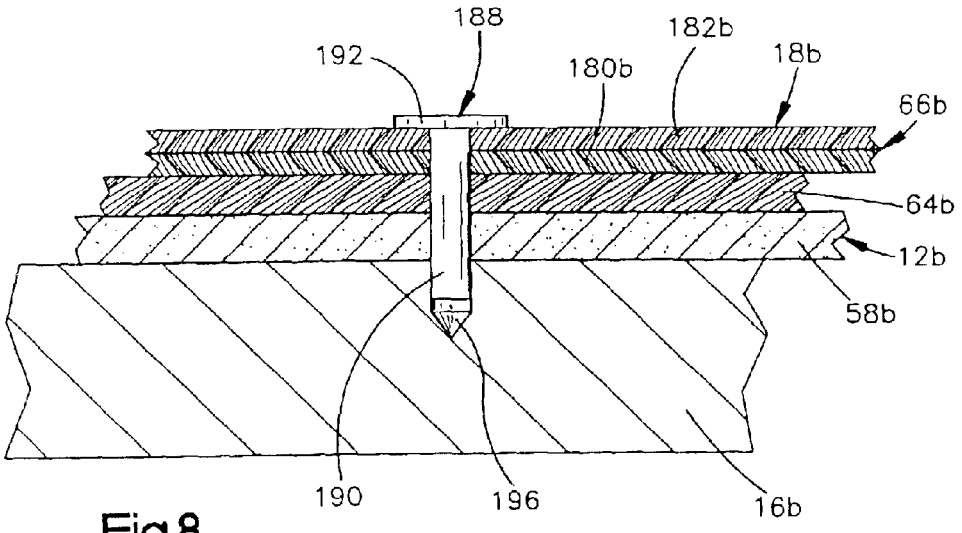
FIG. 8. is a schematic illustration depicting the manner in which a projecting portion of a fastener is utilized to interconnect the baffle of FIG. 7, a mold structure, and the chill plate to position the baffle relative to the mold structure.

In the embodiments of the invention illustrated in FIGS. 1–7, the thermocouple assembly 106 is utilized to orient the baffle 18 relative to the mold structure 12. In the embodiments of the invention illustrated in FIGS. 8 and 9, locating the projections other than the thermocouple assembly 106 are utilized to position the baffle and mold structure relative to each other. Since the embodiment of the invention illustrated in FIG. 8 is generally similar to the embodiments of the invention illustrated in FIGS. 1–7, similar numerals will be utilized to designate similar components, the suffix letter "b" being associated with the numerals of FIG. 8 to avoid confusion.

A mold structure 12*b* is supported on a chill plate 16*b*. The mold structure 12*b* has the same construction as the mold structure 12 of the FIGS. 1 and 2. The chill plate 16*b* may be raised to move the mold structure 12*b* into a furnace assembly (not shown) in the same manner in which the chill plate 16 of FIG. 1 is raised to move the mold structure 12 into the furnace assembly 14. A baffle 18*b* (FIG. 8) has the same general construction as the baffle 18*a* of FIG. 7. The baffle 18*b* includes a base 64*b* and a seal 66*b*. The seal 66*b* is formed by a lower layer 180*b* and an upper layer 182*b*. However, it should be understood that a greater or lesser number of layers could be provided in the seal 66*b* for the baffle 18*b*.

In accordance with a feature of this embodiment of the invention, a locating projection, that is, a pin member 188 (FIG. 8), is utilized to position the baffle 18*b* relative to the mold 12*b*. The pin member 188 has a cylindrical shank portion 190 which is disposed in a coaxial relationship with a circular head end portion 192. The shank portion 190 extends through an opening in the baffle 18*b*. The shank portion 190 also extends through an opening in the base portion 58*b* of the mold structure 12*b*. The shank portion 190 extends into a cylindrical opening or recess 196 in the chill plate 16*b*.

The pin member 188 may be formed of a suitable ceramic or refractory metal. In the embodiment illustrated in FIG. 8, the opening 196 does not extend through the chill plate 16*b*. However, if desired, the opening 196 may extend through the chill plate.

Although only a single pin member 188 is illustrated in FIG. 8, it should be understood that a plurality of pin members 188 may be associated with the baffle 18*b*, mold structure 12*b* and chill plate 16*b*. Thus, a pin member 188 may be associated with each of the baffle segments 80, 82, and 84 (FIG. 2). Of course, more than one pin member may be associated with a baffle segment if desired.

It is believed that the use of a plurality pin members 188 in association with each of the segments 80, 82 and 84 (FIG. 2) of the baffle 18*b* (FIG. 8) will be particularly advantageous when the upper and lower seal layers 180*b* and 182*b* are loosely positioned on the base 64*b* without utilizing adhesive to interconnect the layers. The pin members 188 would interconnect the loose layers 180*b* and 182*b* of the seal 66*b* and the base 64*b* of the baffle 18*b*. In addition, the use of a plurality of pin members would interconnect the baffle 18*b* and the mold 12*b*.

During withdrawal of the mold structure 12*b* from the furnace assembly 14 (FIG. 1), the head end portion 192 (FIG. 8) of the pin member 188 engages the baffle 18*b* to retain the pin member against downward movement with the chill plate 16*b* and mold structure. This results in the shank portion 190 being moved out of the opening 196 in the chill plate 16*b* as the chill plate is lowered. In addition the shank portion 190 is moved out of the opening in the mold structure 12*b* as the mold structure is lowered with the chill plate 16*b*.

The pin member 188 may be formed without the head end portion 192 (FIG. 8). If this was done, the pin member 188 would be formed the cylindrical shank portion 190. Omitting the head end portion 192 of the pin member would enable the cylindrical shank portion 190 to be withdrawn from the opening in the baffle 18*b* as the mold structure 12*b* and chill plate 16*b* are lowered to withdraw the mold structure from the furnace assembly.

If desired, the openings 196 in the chill plate 16*b* may be omitted. If this was done, the pin members 188 would extend into openings in the base portion 58*b* of the mold structure 12*b* to interconnect the mold structure and the baffle 18*b*. The mold structure 12*b* and baffle 18*b* would then be connected with the chill plate 16*b* by frictional engagement between the flat circular lower side surface of the base portion 58*b* of the mold structure 12*b* and a circular upper side surface of the chill plate.

Figure 9:
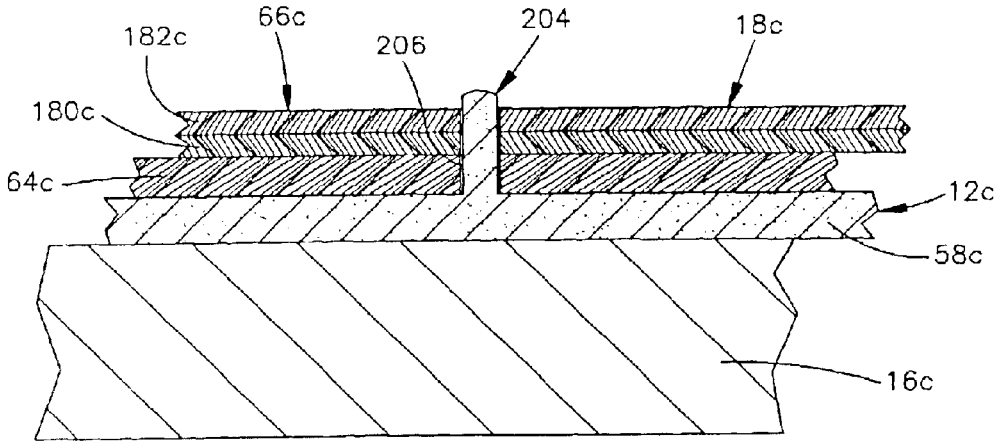
FIG. 9. is a schematic illustration depicting the manner in which a projection from a mold structure is utilized to interconnect the baffle of FIG. 7, the mold structure, and the chill plate to position the baffle relative to the mold structure.

In the embodiment of the invention illustrated in FIG. 9, a projection extends from the mold structure into engagement with the baffle to locate the baffle relative to the mold structure. Since the embodiment of the invention illustrated in FIG. 9 is generally similar to the embodiments of the invention illustrated in FIGS. 1–8, similar numerals will be utilized to designate similar components, the suffix letter "C" being associated with the embodiment of FIG. 9 to avoid confusion.

A mold structure 12*c* is supported on a chill plate 16*c*. A baffle 18*c* cooperates with the mold structure 12*c* and a furnace assembly (not shown) in the same manner as previously described in conjunction with the embodiments of the invention illustrated in FIGS. 1–8.

In accordance with a feature of the embodiment of invention illustrated in FIG. 9, the mold structure 12*c* has a projection 204 which extends through an opening 206 in the baffle 18*c*. The projection 204 positions the baffle 18*c* relative to the mold structure 12*c*.

The baffle 18*c* has a base 64*c* and a seal 66*c*. The seal 66*c* includes a lower layer 180*c* and an upper layer 182*c*. Although the base 64*c* and lower and upper layers 180*c* and 182*c* of the baffle 18*c* may be interconnected by a suitable adhesive, in the embodiment of the invention illustrated in FIG. 9, the adhesive has been omitted. The projection 204 is utilized to interconnect the components of the baffle 18*c*. Of course, the projection 204 also connects the baffle 18*c* with the mold structure 12*c* and the chill plate 16*c*. Although only a single projection 204 is illustrated schematically in FIG. 9, it should be understood that a plurality of projections 204 may extend from the base portion 58*c* through the baffle 18*c* to locate the baffle relative to both the mold structure 12*c* and chill plate 16*c*.

The projection 204 is integrally formed as one piece with the mold structure 12*c*. Thus, the projection 204 is formed by ceramic mold material. However, if desired, the projection 204 may be formed separately from the mold structure 12*c* and connected with the mold structure. As the mold structure 12*c* is withdrawn from the furnace assembly 14, the projection 204 is moved out of the opening 206 (FIG. 9) in the baffle 18*c*.

Alternative Baffle

In the embodiment of the invention illustrated in FIG. 1, the baffle 18 is formed by a plurality of segments 80, 82 and 84 (FIG. 2) which are moved radially inward along the circular base portion 58 of the mold structure 12 to position the baffle segments relative to the mold structure. In the embodiment of the baffle illustrated in FIGS. 10 and 11, the baffle is moved axially along the mold structure to position the baffle relative to the mold structure. Since the baffle of FIGS. 10 and 11 is generally similar to the baffle of FIGS. 1 and 2 and cooperates with a mold structure and furnace assembly in the same general manner as does the baffle of FIGS. 1 and 2, similar numerals will be utilized to designate similar components, the suffix letter "d" being associated with the numerals of FIGS. 10 and 11.

Figure 10:
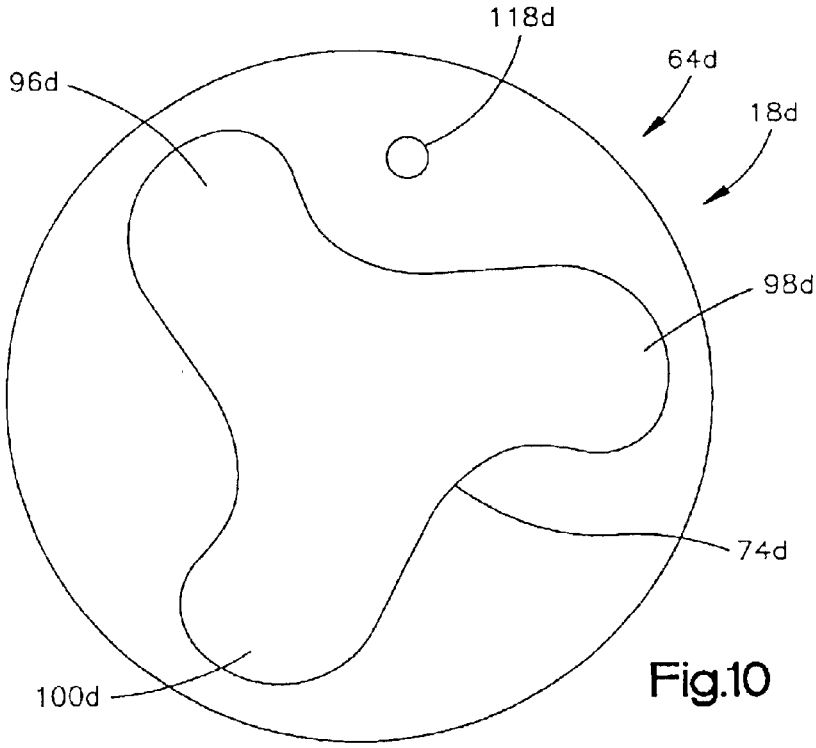
FIG. 10. is a schematic illustration depicting the base of an alternative embodiment of the baffle and illustrating the configuration of a noncircular central opening in the base of the baffle.
Figure 11:
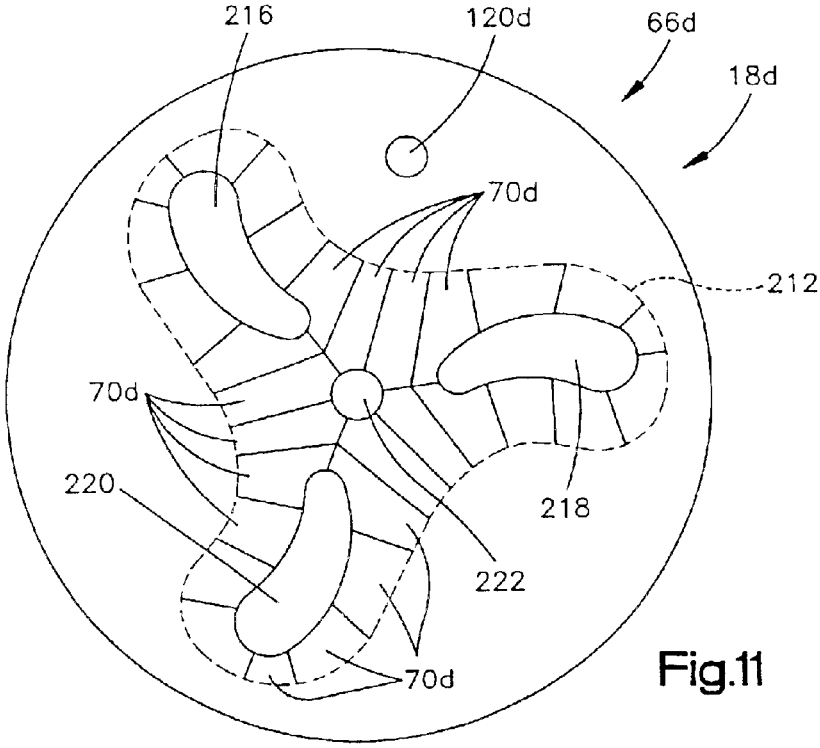
FIG. 11. is a schematic illustration of a seal of the alternative embodiment of the baffle and illustrating the relationship between flexible segments of a sheet which forms the seal of the baffle.

A baffle 18*d* has a one piece circular base 64*d* (FIG. 10) and a one piece circular seal 66*d* (FIG. 11). The base 64*d* (FIG. 10) of the baffle has a noncircular opening 74*d*. The noncircular central opening 74*d* has lobes 96*d*, 98*d* and 100*d*. The lobes 96*d*, 98*d* and 100*d* receive article mold portions 48 (FIG. 1) of a mold structure 12. In addition, the base 64*d* (FIG. 10) has an opening 118*d* through which a thermocouple assembly, corresponding to the thermocouple assembly 106 of FIGS. 2 and 4, may extend.

The opening 74*d* in the base 64*d* may have a configuration which is different than the configuration illustrated in FIG. 10. For example, the opening 74*d* may have a circular or polygonal configuration. The specific configuration of the opening 74*d* will depend, in part, on the configuration of the mold structure 12 with which the baffle 18*d* is to be used.

The base 64*d* is formed of graphite felt. However, the base could have a layered construction with graphite felt disposed between layers of graphite foil. However, it should be understood that the base 64*d* could be composed of other materials, such as a ceramic or a refractory metal.

The seal 66*d* (FIG. 11) has a circular outside diameter which is the same as the circular outside diameter of the base 64*d* (FIG. 10). The seal 66*d* (FIG. 11) has flexible segments 70*d*. The flexible segments 70*d* have root end portions which are disposed in an array having a size and configuration corresponding to the size and configuration of the opening 70*d* (FIG. 10) in the base 64*d*. The configuration of the opening 74*d* has been indicated schematically with dashed lines at 212 in FIG. 11. It should be understood that the dashed line 212 is merely an outline of the configuration of the opening 74*d* in the base 64*d*. The one piece seal 66*d* does not have an opening of the same size and configuration as the opening 74*d* in the base 64*d*.

The flexible segments define the plurality of openings 216, 218 and 220 with configurations which are similar to the cross sectional configurations of the article mold portions 48 of the mold structure 12 (FIG. 2). However, the openings 216, 218 and 220 (FIG. 11) are smaller in size than the cross sectional size of the article mold portions 48 of the mold 12. In addition, the seal portion 66*d* has a circular central opening 222. The circular central opening 222 has a configuration which is the same as the cross sectional configuration of the downpole 54 (FIG. 2). However, the opening 220 (FIG. 11) in the seal 66*d* is smaller than the cross sectional size of the downpole 54.

Figure 4:
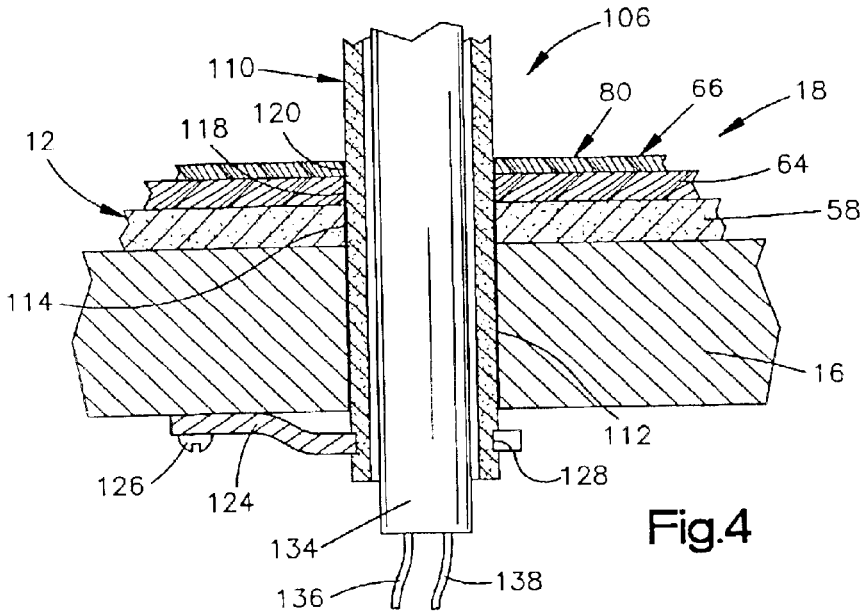
FIG. 4. is an enlarged fragmentary schematic illustration depicting the relationship of a thermocouple assembly to the chill plate, mold structure, and baffle of FIGS. 1 and 2.

The seal 66*d* is provided with an opening 120*d* (FIG. 11) through which a thermocouple assembly, similar to the thermocouple assembly 106 of FIGS. 2 and 4, may extend. The opening 120*d* in the seal 66*d* is the same size as the opening 118*d* (FIG. 10) in the base 64*d*.

The seal 66*d* is formed by a single piece of "GRAFOIL" (Trademark) which is commercially available from Union Carbide Corporation having a place of business at 270 Park Avenue, New York, N.Y. However, it should be understood that the seal 66*d* could be formed of a different material if desired.

The seal 66*d* (FIG. 11) may be connected with the base 64*d* (FIG. 10). If the one piece seal 66*d* is to be connected with the one piece base 64*d*, the opening 120*d* in the seal is aligned with the opening 118*d* in the base. In addition, the root end portions of the flexible segments 70*d* in the seal 66*d* are aligned with the opening 74*d* in the base 64*d*. Thus, the dashed line 212 (FIG. 11) indicating the root end portions of the flexible segments 70*d* is aligned with the edge of the opening 746 in the base 64*d* (FIG. 10). The seal 66*d* may be connected with the base 64*d* by a suitable adhesive or a mechanical fastener, such as a staple.

Assuming that the base 64*d* is to be maintained separate from the seal 66*d*, the base is positioned relative to the mold structure 12 (FIG. 1) before the seal is positioned relative to the mold structure. When the base 64*d* is to be positioned relative to the mold structure, the base is moved axially downward from a location above the pour cup at the upper end of the mold structure 12 (see FIG. 1). As this is done, the opening 118*d* in the base 64*d* is aligned with the opening 114 (FIG. 4) in the base portion 58 of the mold structure 12. The noncircular opening 74*d* in the base 64*d* (FIG. 10) is aligned with the article mold portions 48 (FIGS. 1 and 2).

As the base 64*d* of the seal 18*d* is moved downward onto the mold structure 12, flat major side surfaces of the base 64*d* are maintained in a generally parallel relationship with the base portion 58 of the mold structure 12. At this time, the base 64*d* is disposed in a coaxial relationship with the mold structure. When the base 64*d* has been positioned on the base portion 58 of the mold structure 12, there is an article mold portion 48 aligned with each of the lobes 96*d*, 98*d* and 100*d* of the opening 74*d*.

Once the base 64*d* of the baffle 18*d* has been positioned on the base portion 58 of the mold structure 12, the seal 66*d* is moved axially along the mold structure from a location above the pour cup 44. Before the seal 66*d* is moved downward along the mold, the opening 120*d* in the seal 66*d* is aligned with the opening 118*d* in the base 64*d*. In addition, the openings 216, 218 and 220 in the seal 66*d* are aligned with the article mold portions 48 of the mold structure 12.

The seal 66*d* is then moved downward toward the mold structure 12. As the seal 66*d* is moved downward toward the mold structure, the opening 222 in the seal is disposed in a coaxial relationship with the circular upper end of the pour cup 44. The upper end of the pour cup 44 is effective to resiliently deflect some of the flexible segments 70 of the seal 66*d* upward. As the seal is moved downward onto the mold structure 12, flat major side surfaces of the seal 66*d* are maintained in a generally parallel relationship with the base portion 58 of the mold structure 12. At this time, the seal 66*d* is in a coaxial relationship with the mold structure.

Continued downward movement of the seal 66*d* past the pour cup 44 results in the runner 46 resiliently deflecting additional flexible segments 70*d* of the seal 66*d*. As the seal 66*d* continues to be moved downward, the deflected flexible segments 70*d* resiliently return toward their initial orientation and move into engagement with the downpole 54 and with the outside of the article mold portions 48 of the mold structure 12. The seal 66*d* is moved downward into flat engagement with the upper side surface of the base 64*d*.

When the seal 66*d* has moved into flat engagement with the base 64*d*, the resilient segments will press against the article mold portions 48 and downpole 54 of the mold structure 12. The flexible segments 70*d* will be deflected to an upwardly extending orientation, in the manner indicated schematically in FIG. 1 for the seal 66. At this time, the opening 120*d* (FIG. 11) in the seal 66*d* will be aligned with the opening 118*d* (FIG. 10) in the base 64*d* and with the opening 114 (FIG. 4) in the mold structure 12. In addition, the opening 74*d* (FIG. 10) in the base 64*d* will be entirely blocked by the flexible segments 70*d* (FIG. 11).

The baffle 18*d* may be positioned on the mold structure 12 while the mold structure is disposed on the chill plate 16 or while the mold structure is spaced from the chill plate. Assuming that the baffle 18*d* is placed on the mold structure 12 while the mold structure is spaced from the chill plate 16, the mold structure and baffle 18*d* are moved together onto the chill plate. As the mold structure 12 is positioned on the chill plate 16 (FIG. 1), the opening 114 (FIG. 4) in the base portion 58 of the mold structure is aligned with the opening 112 in the chill plate 16. In addition, the circular periphery of the base portion 58 of the mold and the circular periphery of the baffle 18*d* is aligned with the circular periphery of the chill plate 16.

The thermocouple assembly 106 is then inserted through the opening 112 (FIG. 4) in the chill plate 16 and through the opening 114 in the base portion of the mold structure 12. In addition, the thermocouple assembly 106 is inserted through the opening 118*d* (FIG. 10) in the base portion 64*d* of the baffle 18*d* and through the opening 120*d* (FIG. 11) in the seal portion 66*d* of the baffle 18*d*. The thermocouple assembly 106 is held in place by a suitable bracket 124 (FIG. 4).

If the mold structure 12 is positioned on the chill plate 16 before the baffle 18*d* is positioned on the mold structure, the mold structure is positioned on the chill plate with the opening 114 in the base portion 58 (FIG. 4) of the mold structure aligned with the thermocouple opening 112 in the chill plate. The thermocouple assembly 106 or a projection similar to the projections of FIGS. 8 and 9 may then be positioned relative to the mold structure and the chill plate 16. The bracket 124 and fastener hold the thermocouple assembly in place on the chill plate 16. Of course, if a projection similar to the projections of FIGS. 8 and 9 are used to locate the baffle, the bracket 124 would not be required.

Once the thermocouple assembly 106 has been positioned relative to the chill plate 16 and mold structures 12, the baffle 18*d* may be positioned relative to the mold structure and the thermocouple assembly. This is accomplished by moving the baffle 18*d* downward from a location above the pour cup 44 of the mold structure 12 in the manner previously explained. As the baffle 18*d* is moved downward along the mold structure 12, the thermocouple assembly 106 is inserted into the openings 118*d* in the base 64*d* and the opening 120*d* in the seal portion 66*d*. The base 64*d* and seal 66*d* may be simultaneously moved into position relative to the mold structure 12 or sequentially moved into position relative to the mold structure.

If desired, the baffle 18*d* may be fixedly connected with the lower end portion of the furnace assembly. The mold structure 12 would then be moved into the furnace chamber 24 through the stationary baffle 18*d*.

Although the seal 66*d* (FIG. 11) is formed by one sheet of material, the seal may be formed by a plurality of sheets of material. These sheets of material may have the same peripheral size and placed in a side-by-side relationship to form a multilayered seal. When the seal 66*d* is formed by a plurality of sheets (FIG. 11) to form a multilayered seal, the flexible segments 70*d* on one layer of the seal may have a length which is different than the length of flexible segments on another layer of the seal. For example, an upper sheet may have flexible segments 70*d* which are shorter than the flexible segments of a lower sheet. Alternatively, the lower sheet may have flexible segments 70*d* which are shorter than the flexible segments of the upper sheet.

Although it is believed that it may be preferred to construct the baffle 18*d* with the flexible segments 70*d* to at least partially block heat transfer from the furnace assembly 14, the flexible segments 70*d* may be eliminated if desired. If this was done, the baffle 18*d* may be formed by only the base 64*d* (FIG. 10). The opening 188*d* would be engaged by the thermocouple assembly 106 or a projection having the construction similar to the construction illustrated in FIGS. 8 and 9 to help locate the base 64*d* relative to the chill plate and mold structure.

Conclusion

In view of the foregoing description, it is apparent that the present invention provides a new and improved method and apparatus 10 which is used during casting of molten metal in a mold structure 12. The mold structure 12 may have a single article mold portion 48 or a plurality of article mold portions depending upon whether one or more articles are to be cast in the mold structure. The apparatus 10 includes a movable chill plate 16 which supports the mold structure 12 in a furnace assembly 14. An improved baffle 18 is provided to retard transfer of heat from the mold structure 12 when the mold structure is in the furnace assembly 14 and during withdrawal of the mold structure from the furnace assembly.

It is contemplated that the base 64 of the baffle may be constructed with either a circular or noncircular opening 74. When a plurality of articles are to be cast, the baffle 18 may have a base 64 with a noncircular opening 74. The noncircular opening may have lobes 96, 98 and 100 in which article mold portions 48 of a mold structure 12 for casting a plurality of articles are received. Flexible segments 70 may extend from the base 64 of the baffle 18 into engagement with surfaces of the article mold portions 48 of the mold structure 12.

The chill plate 16 is lowered to withdraw the mold from the furnace assembly 14. During at least a portion of the withdrawal of the mold structure 12 from the furnace assembly 14, the article mold portions 48 of the mold structure 12 are disposed in the lobes 96, 98 and 100 of the noncircular opening 74 in the base 64 of the baffle 18. As the mold structure 12 is withdrawn from the furnace assembly 14, the flexible segments 70 of the baffle 18 at least partially block transfer of heat from the furnace assembly 14. In certain circumstances, it may be desired to omit the flexible segments 70.

When one or more articles are to be cast, the baffle 18 may be positioned relative to the mold structure 12 with the baffle extending around a portion of the mold structure and with flexible segments 70 of the baffle disposed in engagement with the mold structure. The mold structure 12 may be positioned on the chill plate 16 either before or after the baffle 18 is positioned relative to the mold structure. The chill plate 16, mold structure 12 and baffle 18 may be moved upward toward the furnace assembly 14 to move at least a portion of the mold structure 12 into the furnace assembly with the baffle extending around the mold structure. After molten metal has been poured into the mold structure 12, the chill plate 16 and mold structure 12 are moved downward relative to the furnace assembly 14 and baffle 18. As the mold structure 12 is moved downward, flexible segments 70 of the baffle engage the mold structure 12 to at least partially block heat transfer from the furnace assembly 14.

The baffle 18 may advantageously be positioned relative to the mold structure 12 by a projection (FIGS. 4, 8 and 9). The projection may be formed by a thermocouple assembly 106 which extends from the chill plate 16 into the baffle 18. Alternatively, the mold structure 12 may be formed with a projection 204 which extends from the mold structure into the baffle 18. If desired, a member 188 which is separate from the mold structure 12 and the baffle 18 may be moved through an opening in the baffle and the mold structure into an opening in the chill plate 16.

The baffle 18 may be formed with a one piece base 64. The baffle may also include one or more sheets 180 and 182 of material which form a seal in which the flexible segments 70 are formed. The sheet or sheets of material and base 64 of the baffle 18 may each be maintained as one piece (FIGS. 10 and 11). Alternatively, the sheet or sheets of material and base of the baffle 18 may be divided into a plurality of sections 80, 82 and 84 which are positioned relative to the mold structure 12.

Having described the invention, the following is claimed:

1. A method of casting, said method of comprising the steps of positioning a baffle relative to a mold structure with the baffle extending around a portion of the mold structure and with flexible segments of the baffle extending from a base of the baffle into engagement with the mold structure, positioning the mold structure on a chill plate, thereafter, moving the chill plate, mold structure, and baffle, including both the base and flexible segments, upward toward the furnace assembly to move at least a portion of the mold structure into the furnace assembly with the baffle extending around the mold structure, pouring molten metal into the mold structure, moving the chill plate and mold structure downward relative to the furnace assembly and baffle while the flexible segments of the baffle engage the mold structure to at least partially block heat transfer from the furnace assembly, and solidifying molten metal in the mold structure.

2. A method as set forth in claim 1 further including the step of initiating transmission of force between the furnace assembly and the baffle with the mold structure at least partially disposed in the furnace assembly to support the baffle in the furnace assembly with force transmitted between the baffle and furnace assembly.

3. A method as set forth in claim 1 wherein said step of positioning the mold structure on the chill plate is performed before positioning the baffle relative to the mold structure.

4. A method as set forth in claim 1 wherein said step of positioning the mold structure on the chill plate is performed after positioning the baffle relative to the mold structure.

5. A method as set forth in claim 1 wherein said step of positioning the baffle relative to the mold structure includes engaging an opening in the baffle with a projection connected with the mold structure.

6. A method as set forth in claim 5 wherein said step of engaging an opening in the baffle with a projection includes engaging an opening in the baffle with a thermocouple assembly which projects from the chill plate.

7. A method as set forth in claim 5 wherein said step of engaging an opening in the baffle with a projection includes engaging the opening in the baffle with a projection from a portion of the mold structure spaced from article mold portions of the mold structure.

8. A method a set forth in claim 5 wherein said step of engaging an opening in the baffle with a projection includes engaging the opening in the baffle with a member which extends through the baffle and a portion of the mold structure into the chill plate.

9. A method as set forth in claim 5 wherein said step of engaging an opening in the baffle with a projection includes engaging the opening in the baffle with a member which extends from the chill plate through a portion of the mold structure into the baffle.

10. A method as set forth in claim 1 wherein said step of positioning the baffle relative to the mold structure includes positioning a plurality of separate sections of the baffle relative to the mold structure with the flexible segments of the baffle extending from each of the sections of the baffle into engagement with the mold structure.

11. A method as set forth in claim 10 wherein said step of positioning a plurality of separate sections of the baffle relative to the mold structure is performed prior to performance of said step of positioning the mold structure on the chill plate.

12. A method as set forth in claim 11 wherein said step of positioning a plurality of separate sections of the baffle relative to the mold structure is performed after performance of said step of positioning the mold structure on the chill plate.

13. A method as set forth in claim 10 further including the step of interconnecting the separate sections of the baffle after positioning the separate sections of the baffle relative to the mold structure.

14. A method as set forth in claim 1 wherein the base of the baffle includes is formed as one piece in which a noncircular opening is formed and from which the flexible segments extend, said step of positioning the baffle relative to the mold structure includes positioning the base of the baffle around a portion of the mold structure.

15. A method as set forth in claim 1 wherein the flexible segments of the baffle are formed from a single sheet of material, said step of positioning the baffle relative to the mold structure includes positioning the single sheet of material around the mold structure with the flexible segments disposed in engagement with the mold structure.

16. A method as set forth in claim 1 wherein base of the baffle is formed as one piece, in which a noncircular opening is formed and wherein the flexible segments of the baffle are formed from a single sheet of material, said step of positioning the baffle relative to the mold structure includes positioning the one piece base of the baffle around the mold structure and positioning the single sheet of material around the mold structure with the flexible segments of the baffle engaging the mold structure.

17. A method as set forth in claim 16 wherein the one piece base of the baffle and the single sheet of material are interconnected, said steps of positioning the one piece base of the baffle around the mold structure and positioning the single sheet of material around the mold structure are performed at the same time.

18. A method as set forth in claim 16 wherein the one piece base of the baffle and the single sheet of material are interconnected, said steps of positioning the one piece base of the baffle around the mold structure and positioning the single sheet of material around the mold structure are performed at the same time.

19. A method as set forth in claim 16 wherein said steps of positioning the one piece base of the baffle around the mold structure and positioning the single sheet of material around the mold structure are performed before performing said step of positioning the mold structure on the chill plate.

20. A method as set forth in claim 16 wherein said steps of positioning the one piece base of the baffle around the mold structure and positioning the single sheet of material around the mold structure are performed after performing said step of positioning the mold structure on the chill plate.

21. A method as set forth in claim 1 further including the step of supporting the baffle with a plurality of members during at least a portion of the downward movement of the chill plate and mold structure and moving the members to release the baffle for downward movement relative to the furnace assembly.

22. A method as set forth in claim 1 wherein the mold structure has a plurality of article mold portions, said step of positioning the baffle relative to the mold structure includes positioning the baffle with the flexible segments of the baffle in engagement with the article mold portions of the mold structure.

23. A method as set forth in claim 1 wherein the mold structure has a plurality of article mold portions, said step of positioning the baffle relative to the mold structure includes positioning the baffle with the article mold portions of the mold structure in lobes formed in a noncircular opening in a base portion of the baffle.

24. A method as set forth in claim 1 wherein the mold structure includes a base and at least one article mold portion which extends upward from the base of the mold structure, said step of positioning the baffle relative to the mold structure includes positioning the baffle on the base of the mold structure.

25. A method as set forth in claim 1 wherein the mold structure has a plurality of article mold portions, said step of positioning the baffle relative to the mold structure includes aligning the mold structure and baffle relative to each other with article mold portions of the mold structure aligned with lobes of a noncircular opening in the base of the baffle, said step of moving the chill plate, mold structure, and baffle upward toward the furnace assembly is at least partially performed with the article mold portions of the mold structure aligned with the lobes of the noncircular opening in the base of the baffle and with flexible segments of the baffle extending across edges of the lobes formed in the noncircular opening in the base of the baffle into engagement with surfaces the mold structure, said step of moving the chill plate and mold structure downward relative to the furnace assembly and baffle includes moving at least a portion of the mold structure out of the furnace assembly with the article mold portions of the mold structure in the lobes of the noncircular opening in the base of the baffle and with the flexible segments of the baffle extending from the base of the baffle across edges of the lobes formed in the noncircular opening in the base of the baffle into engagement with outer surfaces of the article mold portions of the mold structure to at least partially block transfer of heat from the furnace assembly.

26. A method as set forth in claim 25 wherein said step of positioning the baffle relative to the mold structure includes engaging an opening in the baffle with a projection connected with the mold structure.

27. A method as set forth in claim 25 wherein said step of engaging an opening in the baffle with a projection includes engaging the opening in the baffle with a thermocouple assembly which projects from the chill plate.

28. A method as set forth in claim 26 where said step of engaging an opening in the baffle with a projection includes engaging the opening in the baffle with a projecting portion of the mold structure.

29. A method as set forth in claim 26 wherein said step of engaging an opening in the baffle with a projection includes engaging the opening in the baffle with a member which extends through the baffle and a portion of the mold structure into the chill plate.

30. A method as set forth in claim 26 wherein said step of engaging an opening in the baffle with a projection includes engaging the opening in the baffle with a member which extends from the chill plate through a portion of the mold structure into the baffle.

31. A method as set forth in claim 25 wherein said step of positioning the baffle relative to the mold structure includes positioning a plurality of separate sections of the baffle relative to the mold structure with the flexible segments of the baffle extending from each of the sections of the baffle into engagement with the surfaces of at least one of the article mold portions of the mold structure.

32. A method as set forth in claim 31 further including the step of interconnecting the separate sections of the baffle after positioning the separate sections of the baffle relative to the mold structure.

33. A method as set forth in claim 25 wherein the base of the baffle is formed as one piece in which the noncircular opening is formed, said step of positioning the baffle relative to the mold structure includes positioning the base of the baffle around the article mold portions of the mold structure.

34. A method as set forth in claim 25 wherein the flexible segments of the baffle are formed from a single sheet of material, said step of positioning the baffle relative to the mold structure includes positioning the single sheet of material around the article mold portions of the mold structure with the flexible segments disposed in engagement with the article mold portions of the mold structure.

35. A method as set forth in claim 25 wherein the base of the baffle is formed as one piece in which the noncircular opening is formed and wherein the flexible segments of the baffle are formed from a single sheet of material, said step of positioning the baffle relative to the mold structure includes positioning the one piece base of the baffle around the article mold portions of the mold structure and positioning the single sheet of material around the article mold portions of the mold structure.

36. A method as set forth in claim 25 further including the step of positioning the mold structure relative to the furnace assembly after performing said steps of positioning the base of the baffle around the article mold portions and positioning the single sheet of material around the article mold portions.

37. A method as set forth in claim 25 further including the steps of supporting the baffle with a plurality of members during at least a portion of the movement of the mold and chill plate in the second direction and moving the members to release baffle for movement the second direction relative to the furnace assembly.

38. A method as set forth in claim 1 wherein said step of moving the chill plate and mold structure downward relative to the furnace assembly includes lowering the chill plate and mold structure relative to the furnace assembly and baffle through a distance which is greater than the vertical height of an article mold cavity, engaging an irregular side portion of the mold structure with the flexible segments of the baffle, and maintaining the flexible segments of the baffle in engagement with the irregular side portion of the mold structure while the mold structure is lowered through a distance which is at least substantially as great as the vertical height of the article mold cavity.

39. A method as set forth in claim 38 wherein said step of maintaining the flexible segments of the baffle in engagement with the irregular side portion of the mold structure includes maintaining flexible segments of the baffle in engagement with the irregular side portion of the mold structure by resiliently flexing the segments of the baffle toward and away from a central axis of the baffle as the mold structure is lowered.

40. A method as set forth in claim 39 wherein said step of flexing the segments of the baffle toward and away from the central axis of the baffle as the mold structure is lowered includes flexing the segments away from the central axis of the baffle under the influence of force applied against end portions of the segments by the irregular side portion of the mold structure.

41. A method as set forth in claim 40 wherein said step of flexing the segments of the baffle toward and away from the central axis of the baffle as the mold structure is lowered includes flexing the segments toward the central axis of the baffle under the influence of the natural resilience of the material forming the flexible segments.

42. A method as set forth in claim 39 wherein said step of flexing the segments of the baffle toward and away from the central axis of the baffle as the mold structure is lowered includes flexing the segments toward the central axis of the baffle under the influence of force applied against end portions of the segments by the irregular side portion of the mold structure.

43. A method as set forth in claim 39 wherein said step of flexing the segments of the baffle toward and away from a central axis of the baffle as the mold structure is lowered includes flexing at least one of the segments between an orientation in which an end portion of the one segment points upwardly and an orientation in which the end portion of the one segment points downwardly.

44. A method as set forth in claim 39 wherein said step of resiliently flexing the segments of the baffle includes resiliently flexing one of the segments relative to an adjacent segment without transmitting force from the one segment to the adjacent segment.

45. A method as set forth in claim 38 further including the step of connecting the baffle with the furnace assembly after at least a portion of the mold structure has been moved into the furnace assembly by movement of the chill plate, mold structure and baffle upward toward the furnace assembly.

46. A method as set forth in claim 1 wherein said step of positioning the baffle relative to the mold structure includes engaging the baffle with a thermocouple assembly, said step of moving the chill plate, mold structure, and baffle upward toward a furnace assembly is at least partially performed with the thermocouple assembly in engagement with the baffle, said method further includes providing an output from the thermocouple assembly indicative of temperature in at least a portion of the furnace assembly while at least a portion of the mold structure is disposed in the furnace assembly.

47. A method as set forth in claim 46 wherein said step of positioning the baffle relative to the mold structure includes positioning a plurality of separate sections of the baffle relative to the mold structure, said step of engaging the baffle with the thermocouple assembly includes engaging one of the sections of the baffle with the thermocouple assembly.

48. A method as set forth in claim 47 wherein said step of positioning a plurality of separate sections of the baffle relative to the mold structure is performed prior to the performance of said step of positioning the mold structure on the chill plate.

49. A method as set forth in claim 47 wherein said step of positioning a plurality of separate sections of the baffle relative to the mold structure is performed after performance of said step of positioning the mold structure on the chill plate.

50. A method as set forth in claim 47 further including the step of interconnecting the separate sections of the baffle after positioning the separate sections of the baffle relative to the mold structure, said step of interconnecting the separate sections of the baffle is performed with the thermocouple assembly engaging said one of the sections of the baffle.

51. A method as set forth in claim 46 wherein a central opening is formed in the base of the baffle and a second opening is formed, in the base of the baffle said step of positioning the baffle relative to the mold structure includes positioning a portion of the mold in the central opening and positioning a portion of the thermocouple assembly in the second opening.

52. A method as set forth in claim 1 wherein said step of positioning a baffle relative to a mold structure includes positioning the baffle with a portion of the mold structure extending through a central opening in the baffle and with a projection extending through a second opening in the baffle at a location spaced from the central opening, said step of moving the chill plate, mold structure, and baffle upward toward the furnace assembly is performed with the mold structure extending through the central opening in the baffle and with the projection extending through the second opening in the baffle, said step of moving the chill plate and mold structure downward relative to the furnace assembly and baffle includes separating the projection from at least one of the second opening in the baffle and the mold structure while a portion of the mold structure is in the central opening in the baffle and moving the mold structure out of the central opening in the baffle after the projection has separated from at least one of the second opening in the baffle and the mold structure.

53. A method as set forth in claim 52 wherein the projection is at least partially formed by a thermocouple assembly, said method further includes providing an output from the thermocouple assembly indicative of temperature in at least a portion of the furnace assembly, said step of separating the projection from at least one of the second opening in the baffle and the mold structure includes separating the projection from the second opening in the baffle.

54. A method as set forth in claim 52 wherein the projection is at least partially formed by a portion of the mold structure which is spaced from the portion of the mold structure disposed in the central opening in the baffle, said step of separating the projection from at least one of the second opening in the baffle and the mold structure includes separating the projection from the second opening in the baffle.

55. A method as set forth in claim 52 further including the step of initiating transmission of force between the furnace assembly and the baffle with the mold structure at least partially disposed in the furnace assembly to support the baffle in the furnace assembly with force transmitted between the baffle and furnace assembly.

56. A method as set forth in claim 52 wherein the projection extends between the mold structure and baffle, said step of separating the projection from at least one of the opening in the baffle and the mold structure includes separating the projection from the baffle.

57. A method as set forth in claim 52 wherein the projection extends between the mold structure and the baffle, said step of separating the projection from at least one of the opening in the baffle and the mold structure includes separating the projection from the mold structure.

58. A method as set forth in claim 52 wherein the projection extends from the chill plate through the mold structure into the baffle, said step of separating the projection from at least one of the opening in the baffle and the mold structure includes separating the projection from the baffle.

59. A method as set forth in claim 52 wherein the projection extends from the chill plate through the mold structure into the baffle, said step of separating the projection from at least one of the openings in the baffle and the mold structure includes separating the projection from the mold structure and the chill plate.

60. A method as set forth in claim 52 wherein said step of positioning the baffle relative to the mold structure includes positioning a plurality of separate sections of the baffle relative to the mold structure with the second opening in the baffle disposed in one of the segments of the baffle.

61. A method as set forth in claim 60 wherein said step of positioning a plurality of separate sections of the baffle relative to the mold structure is performed prior to performance of said step of positioning the mold structure on the chill plate.

62. A method as set forth in claim 60 wherein said step of positioning a plurality of separate sections of the baffle relative to the mold structure is performed after performance of said step of positioning the mold structure on the chill plate.

63. A method as set forth in claim 60 further including the step of interconnecting the separate sections of the baffle after positioning the separate sections of the baffle relative to the mold structure.

64. A method as set forth in claim 52 wherein the base of the baffle is formed as one piece in which a noncircular opening is formed, said step of positioning the baffle relative to the mold structure includes positioning the base of the baffle around a portion of the mold structure.

65. A method as set forth in claim 52 wherein said step of positioning a baffle relative to the mold structure includes engaging a portion of the mold structure with flexible segments of the baffle, said step of moving the chill plate and mold structure downward relative to the furnace assembly and baffle is at least partially performed with the flexible segments of the baffle engaging the mold structure to at least partially block heat transfer from the furnace assembly.

66. A method as set forth in claim 1 wherein the mold structure has a plurality of article mold portions, said step of positioning the baffle relative to the mold structure includes aligning the mold structure and baffle relative to each other with article mold portions of the mold structure aligned with lobes in the baffle, said step of moving chill plate, mold structure, and baffle upward toward the furnace assembly is at least partially performed with the article mold structure aligned with the lobes in the baffle, said step of moving the chill plate and mold structure downward relative to the furnace assembly and baffle includes moving at least a portion of the mold structure out of the furnace assembly with the article mold portions of the mold structure in the lobes in the baffle to at least partially block transfer of heat from the furnace assembly.

67. A method as set forth in claim 66 wherein said step of positioning the baffle relative to the mold structure is at least partially performed with the flexible segments of the baffle extending from the lobes in the baffle toward the article mold portions.

* * * * *

UNITED STATES PATENT AND TRADEMARK OFFICE

CERTIFICATE OF CORRECTION

PATENT NO. : 6,827,124 B2
DATED : December 7, 2004
INVENTOR(S) : Robert M. Garlock et al.

It is certified that error appears in the above-identified patent and that said Letters Patent is hereby corrected as shown below:

Column 22,
Line 45, after "claim" change "11" to -- 10 --.
Line 66, after "wherein" insert -- the --.

Column 24,
Line 16, after "claim" change "25" to -- 26 --.

Signed and Sealed this

Twenty-fourth Day of May, 2005

JON W. DUDAS
*Director of the United States Patent and Trademark Office*